US007733361B2

(12) United States Patent
Choi et al.

(10) Patent No.: US 7,733,361 B2
(45) Date of Patent: Jun. 8, 2010

(54) PRINTER CARTRIDGE UNIFYING THERMAL RIBBON AND TRANSFER MEDIUM AND THERMAL TRANSFER PRINTER EMPLOYING THE SAME

(76) Inventors: Woo Sung Choi, 105-201 Jugong Green Vil., 1258 Maetan-dong, Yeongtong-gu, Suwon-si, Gyeonggi-do 443-370 (KR); Sung Min Park, 102-1204 Seonbi Maul, Samjeong Apt. Bora-dong, Gihung-gu, Yongin-si, Gyeonggi-do 449-953 (KR)

( * ) Notice: Subject to any disclaimer, the term of this patent is extended or adjusted under 35 U.S.C. 154(b) by 28 days.

(21) Appl. No.: 11/915,144

(22) PCT Filed: May 2, 2006

(86) PCT No.: PCT/KR2006/001642

§ 371 (c)(1),
(2), (4) Date: Aug. 1, 2008

(87) PCT Pub. No.: WO2006/123865

PCT Pub. Date: Nov. 23, 2006

(65) Prior Publication Data

US 2009/0046136 A1 Feb. 19, 2009

(30) Foreign Application Priority Data

| | | |
|---|---|---|
| May 20, 2005 | (KR) | 10-2005-0042264 |
| May 30, 2005 | (KR) | 10-2005-0045744 |
| Jun. 15, 2005 | (KR) | 10-2005-0051227 |
| Jun. 24, 2005 | (KR) | 10-2005-0055078 |
| Aug. 23, 2005 | (KR) | 10-2005-0077076 |
| Nov. 22, 2005 | (KR) | 10-2005-0111948 |

(51) Int. Cl.

| | |
|---|---|
| ***B41J 2/315*** | (2006.01) |
| ***B41J 15/00*** | (2006.01) |
| ***B41J 15/04*** | (2006.01) |

(52) U.S. Cl. ..... 347/171; 347/214

(58) Field of Classification Search ..... 347/221, 347/214, 171, 101, 104; 400/120.01, 207, 400/208

See application file for complete search history.

(56) References Cited

U.S. PATENT DOCUMENTS 4,904,100 A 2/1990 Enix (Continued)

OTHER PUBLICATIONS

International Search Report.

*Primary Examiner*—Huan H Tran
(74) *Attorney, Agent, or Firm*—Staas & Halsey LLP

(57) ABSTRACT

A thermal transfer printer having simpler structure, occupying less installation space, and enhancing the user convenience. The thermal transfer printer includes a cartridge having print paper wound in a roll, a capstan roller for conveying the print paper by applying frictional force on the print paper, a printing head for printing images on the print paper, and a platen roller for selectively pressing the print paper against the printing head. The housing of the cartridge has a first opening penetrating the housing and extending laterally. A paper roll case is rotatably installed in the housing and has a second opening penetrating the paper roll case and extending laterally. Inside the paper roll case, a paper roll is stuck on the inner surface of the paper roll case, and print paper is wound from the inner surface of the paper roll case to inward direction, while a first end of the print paper is exposed through the second opening.

30 Claims, 14 Drawing Sheets

U.S. PATENT DOCUMENTS 4,914,452 A * 4/1990 Fukawa ..... 347/214
5,618,117 A 4/1997 Yoshida
5,758,982 A 6/1998 Yoshida
6,307,582 B1 * 10/2001 Kawato et al. ..... 347/214
6,362,868 B1 3/2002 Silverbrook
6,522,349 B1 * 2/2003 Lee ..... 347/214
2002/0197091 A1 12/2002 Otsuki

* cited by examiner

[Fig. 1] (PRIOR ART)
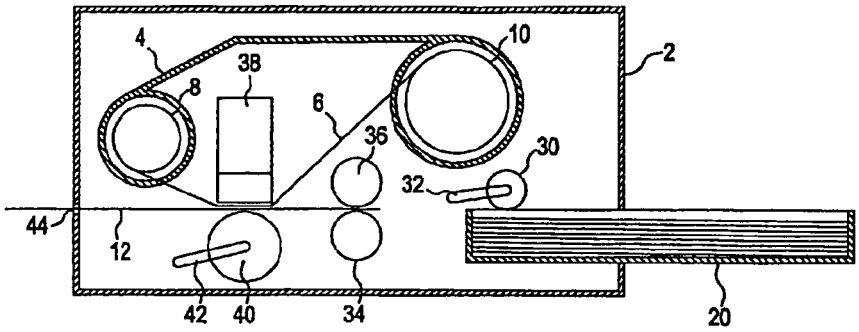
[Fig. 2]
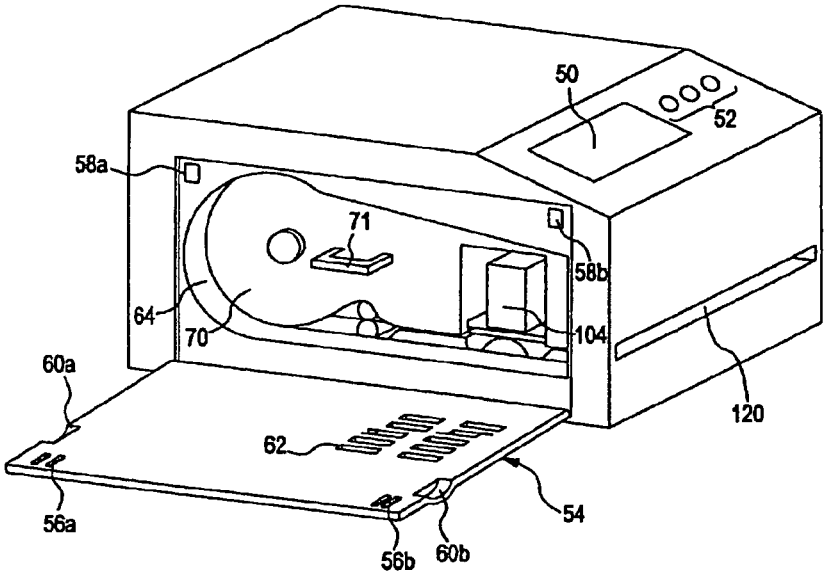
[Fig. 3]
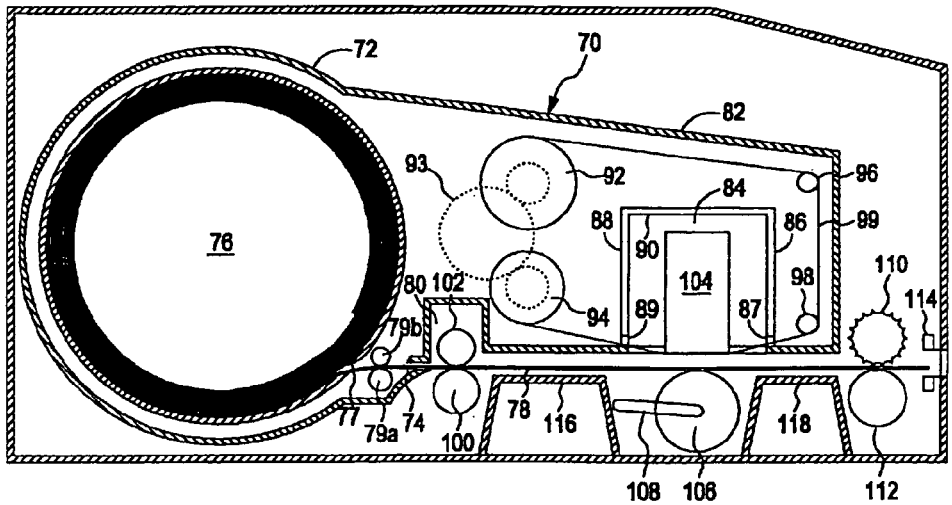

[Fig. 4]
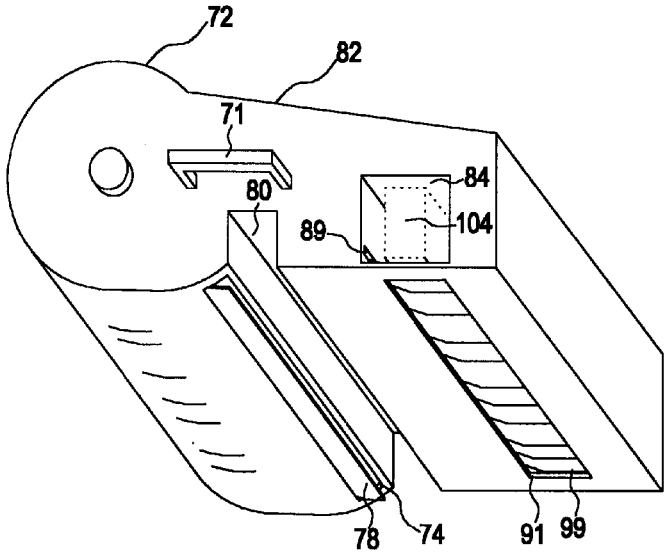
[Fig. 5]
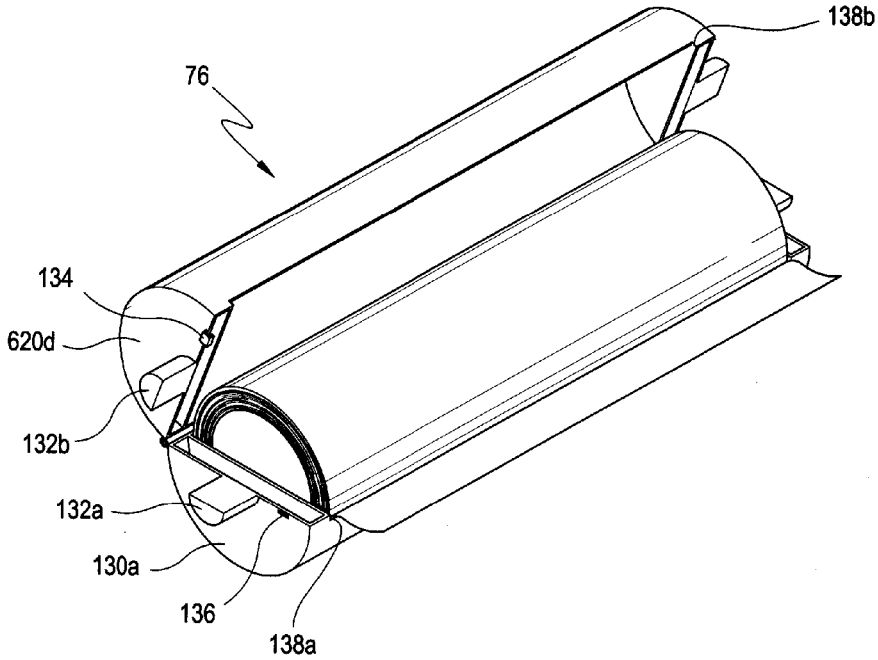
[Fig. 6]
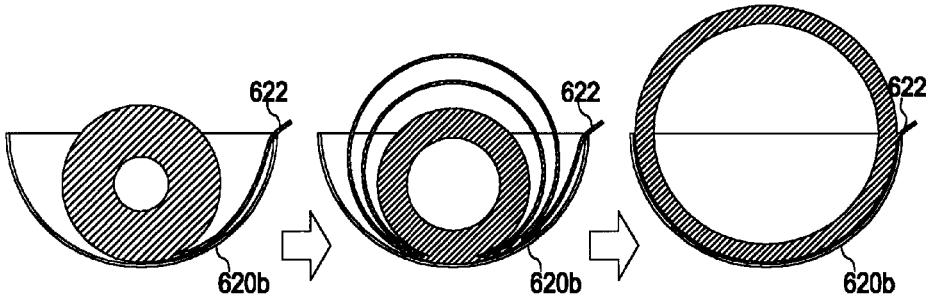

[Fig. 7]
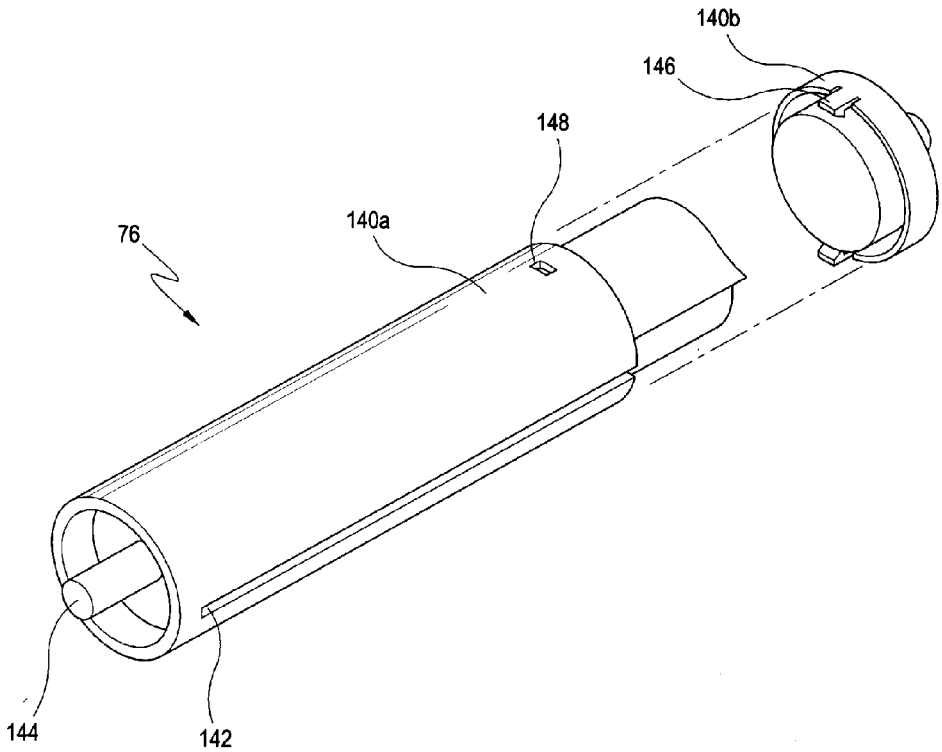
[Fig. 8]
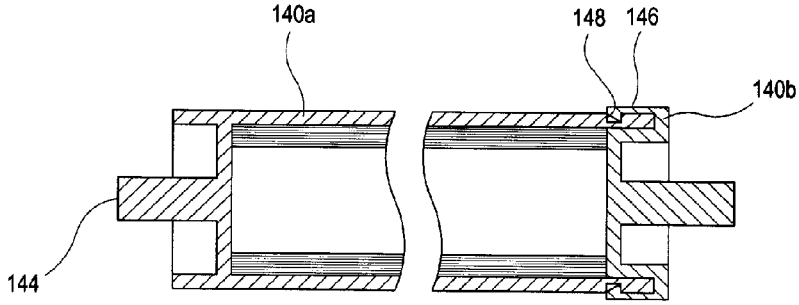
[Fig. 9]
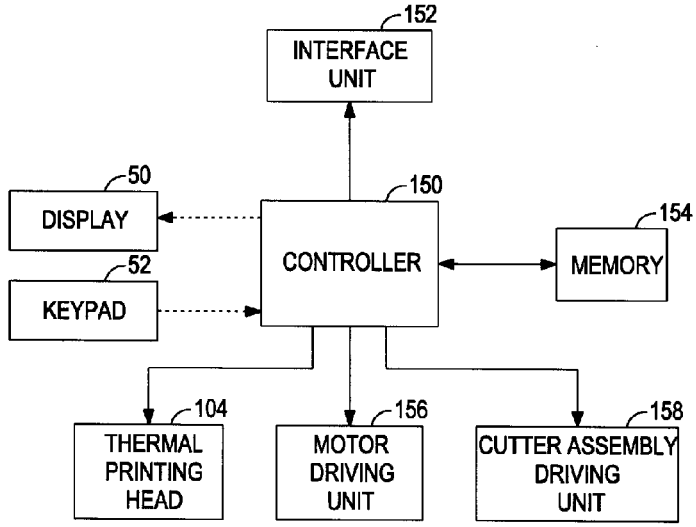

[Fig. 10]
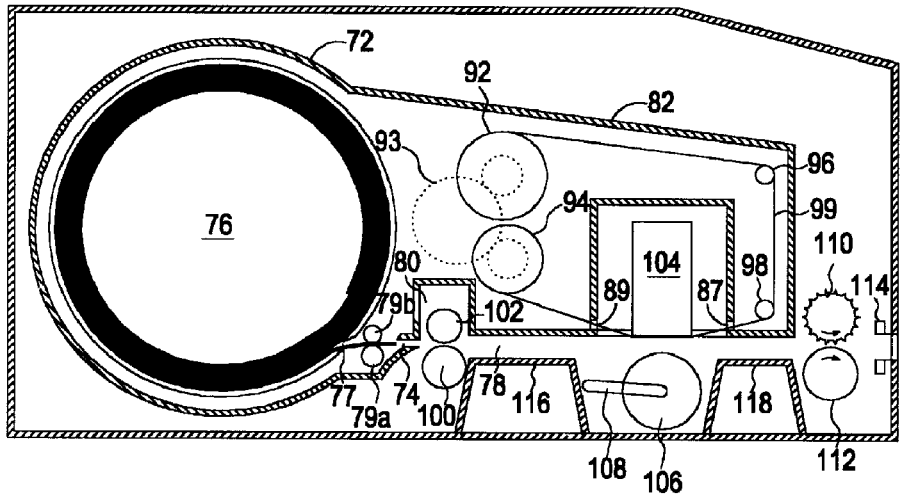
[Fig. 11]
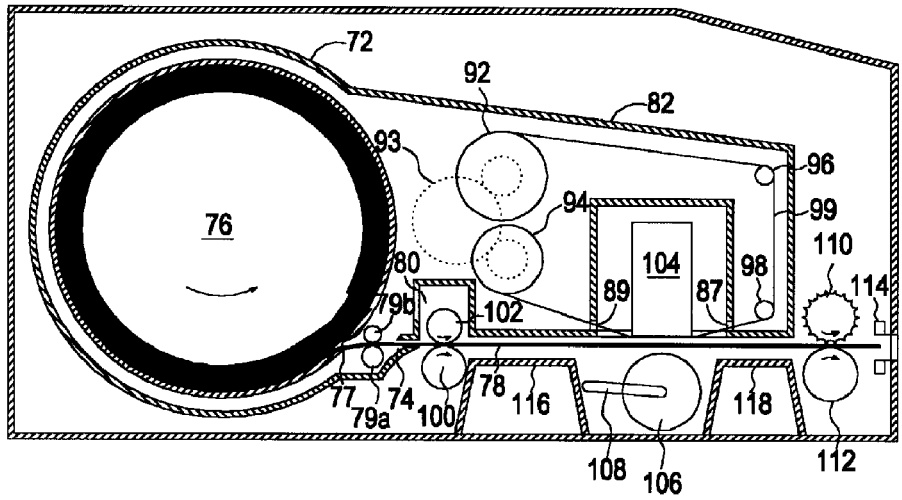
[Fig. 12]
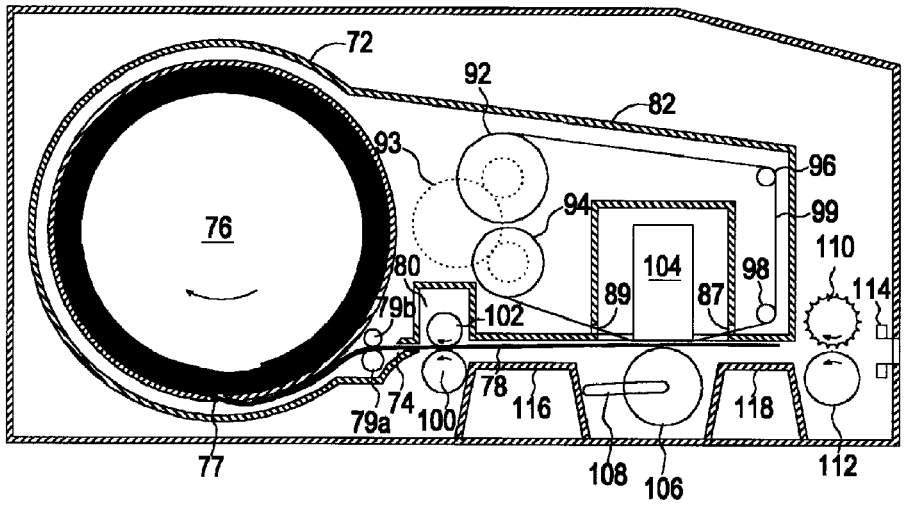

[Fig. 13]
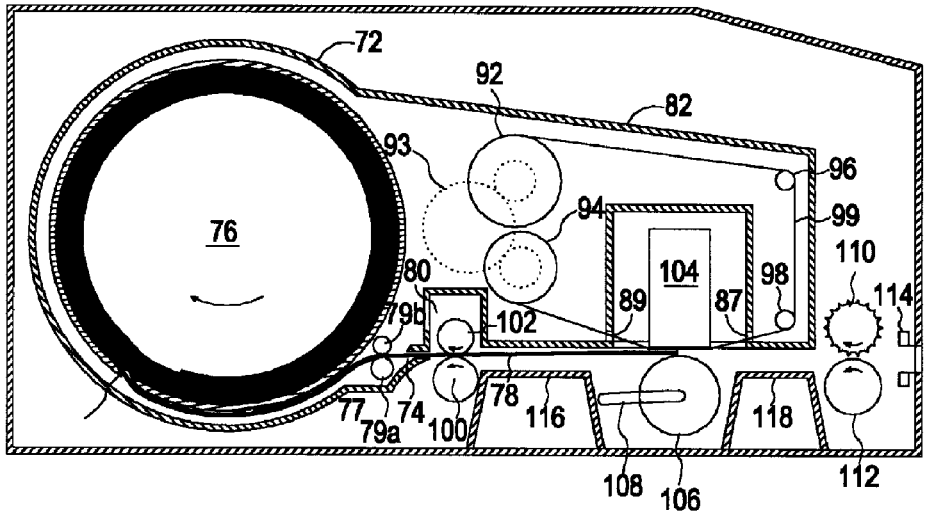
[Fig. 14]
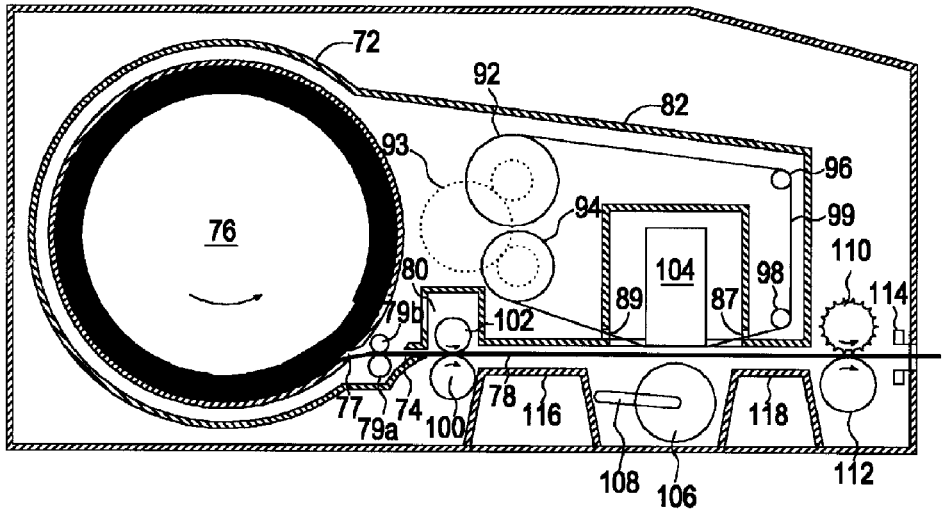
[Fig. 15]
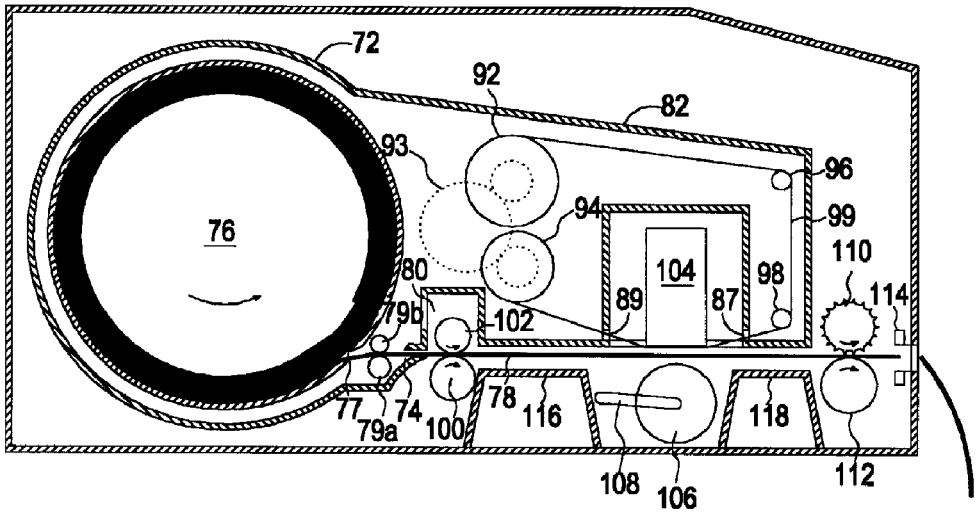

[Fig. 16]
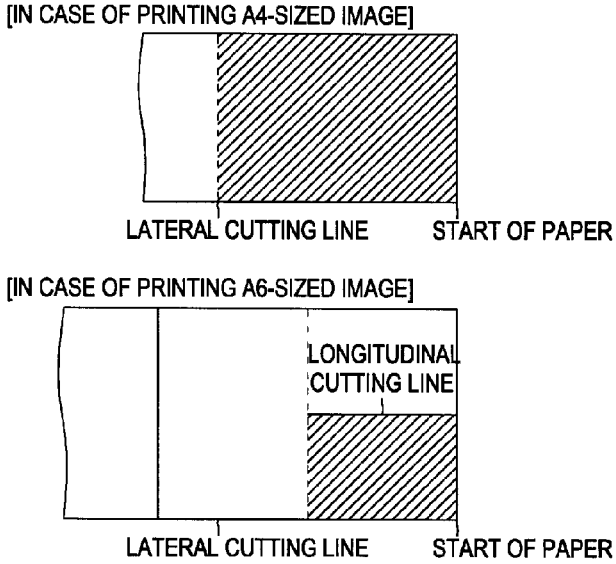
[Fig. 17]
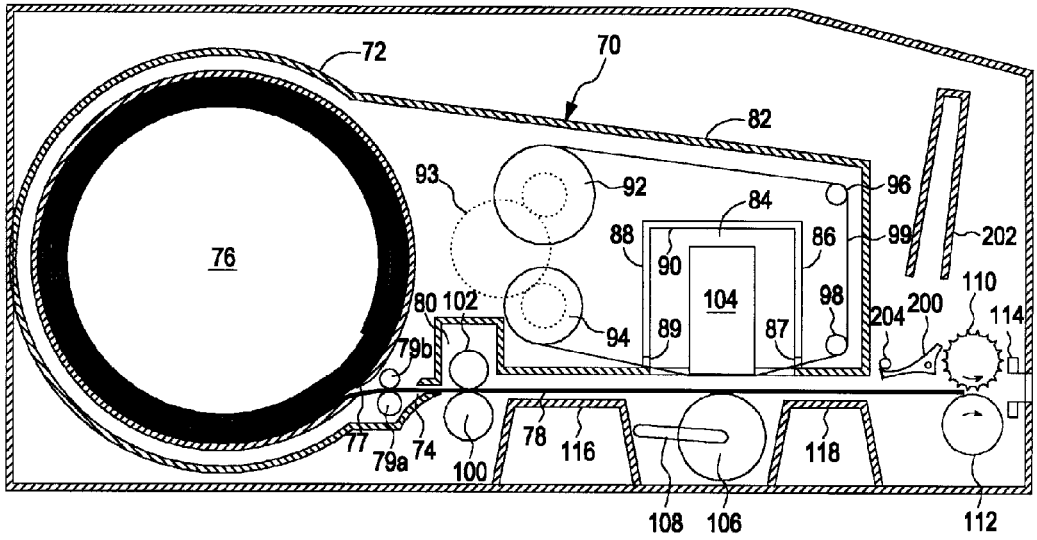
[Fig. 18]
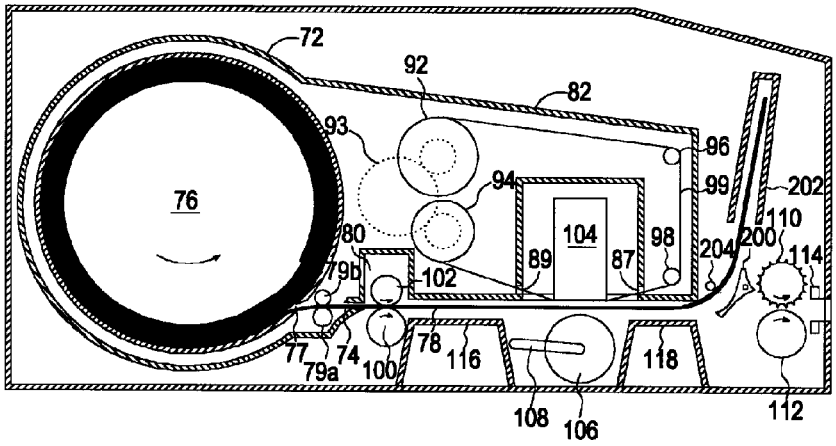

[Fig. 19]
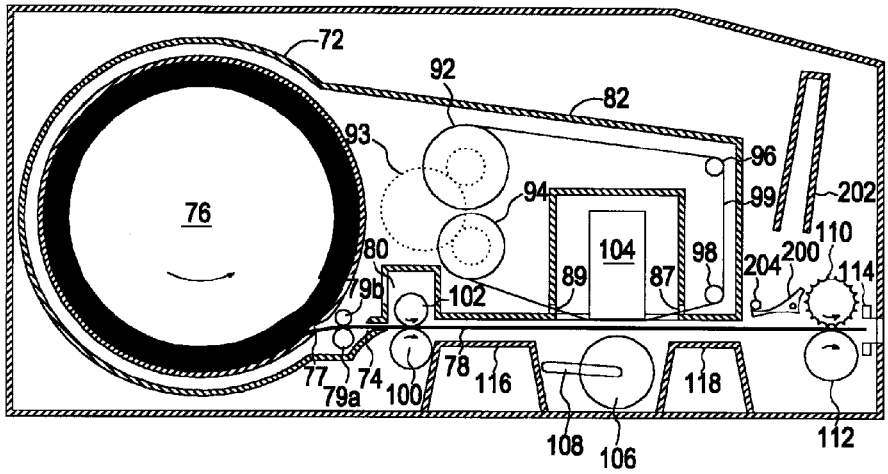
[Fig. 20]
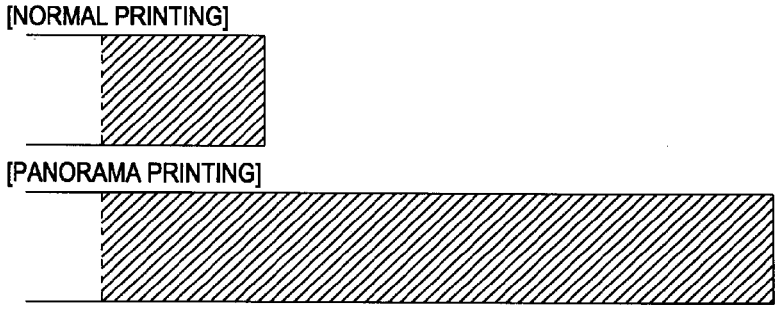
[Fig. 21]
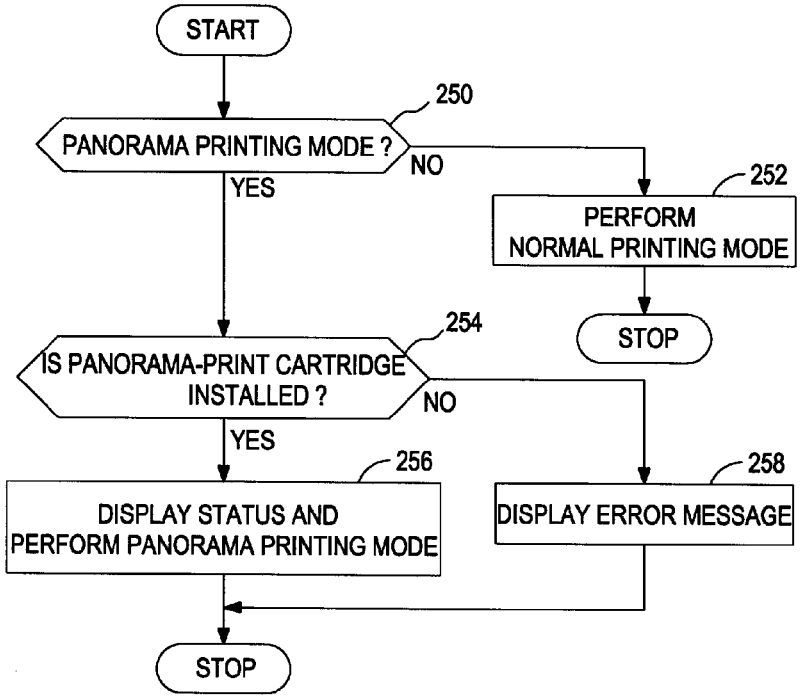

[Fig. 22]
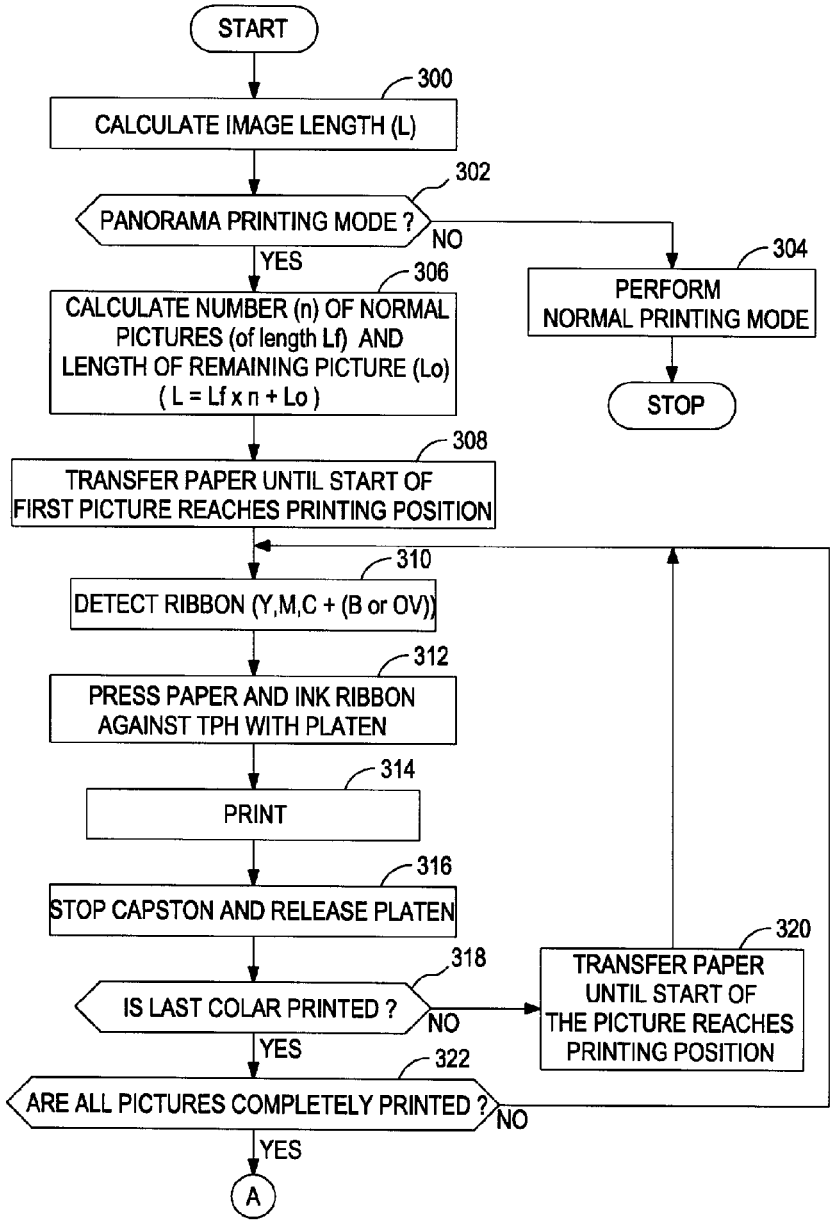
[Fig. 23]
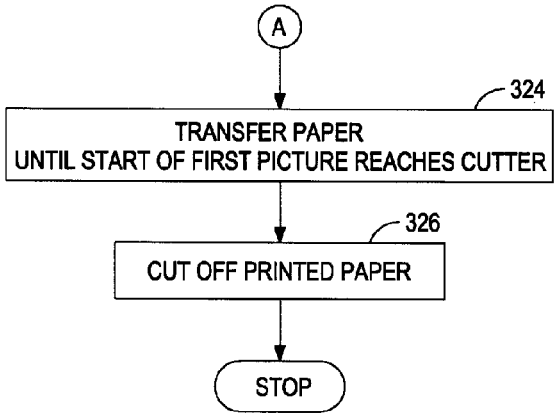

[Fig. 24]
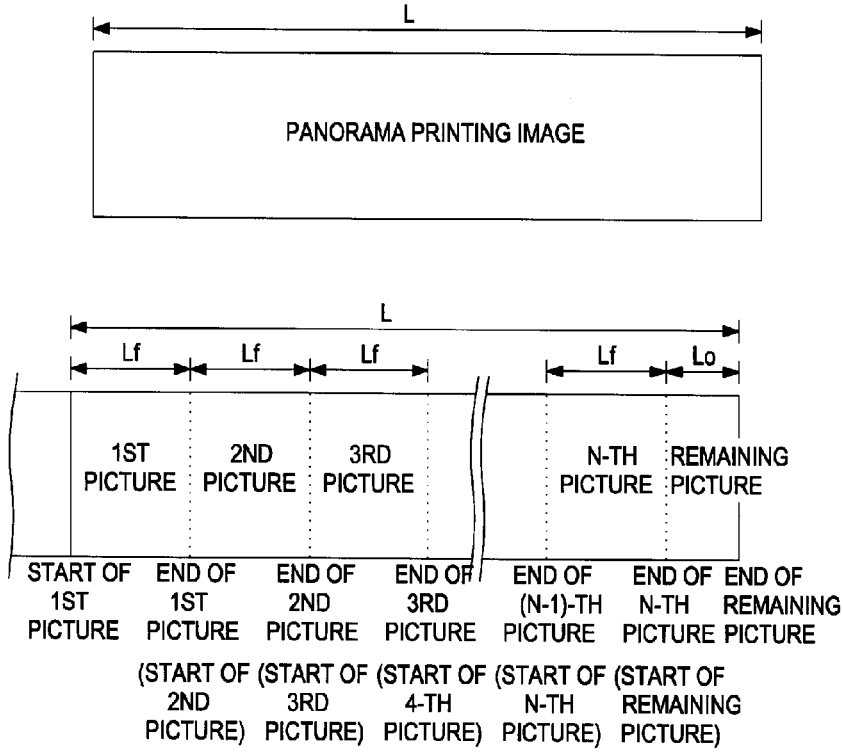
[Fig. 25]
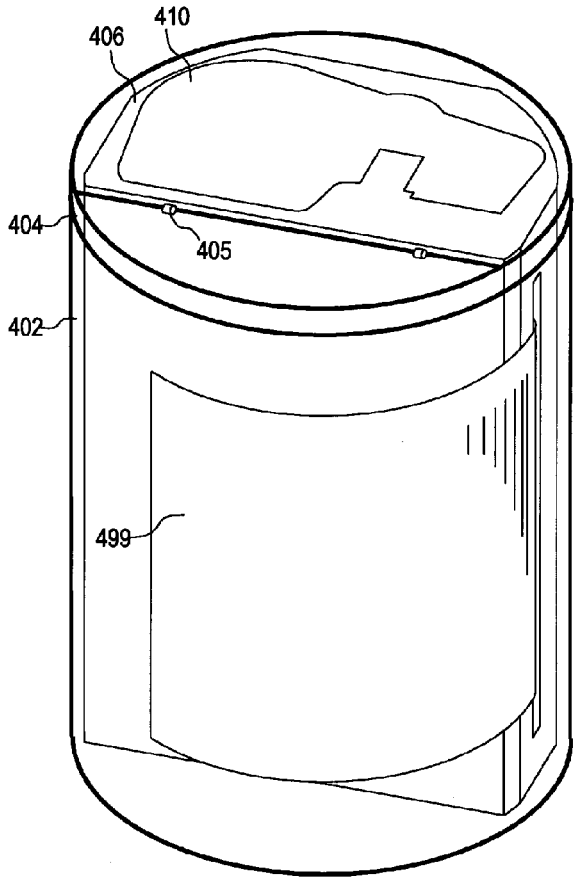

[Fig. 26]
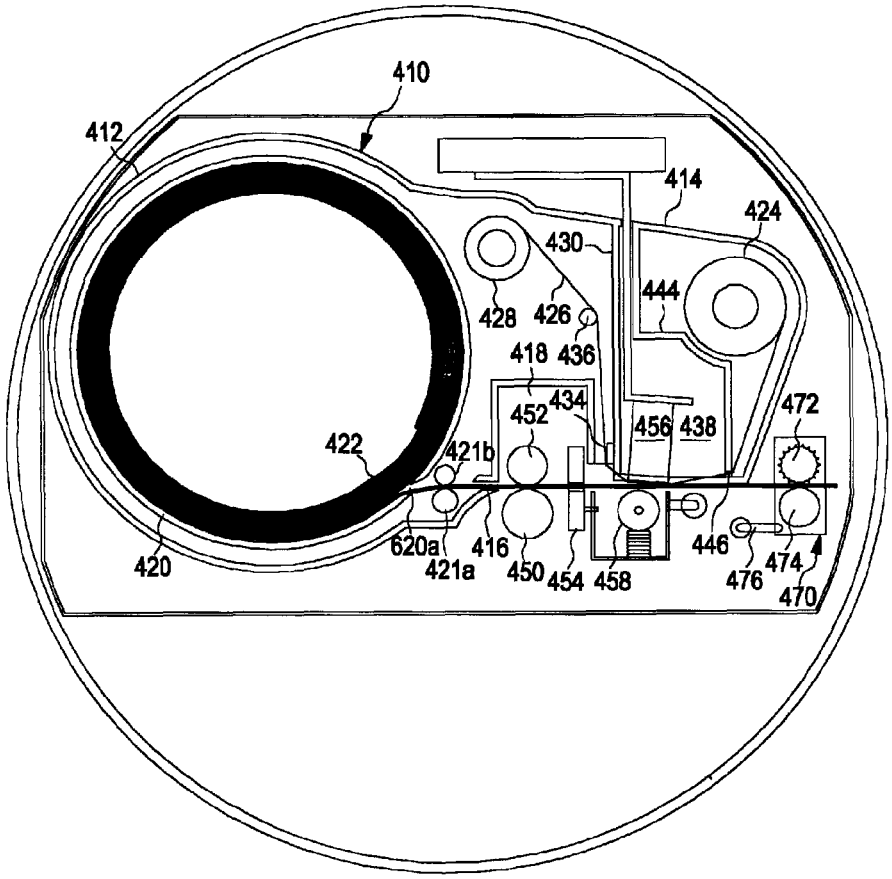
[Fig. 27]
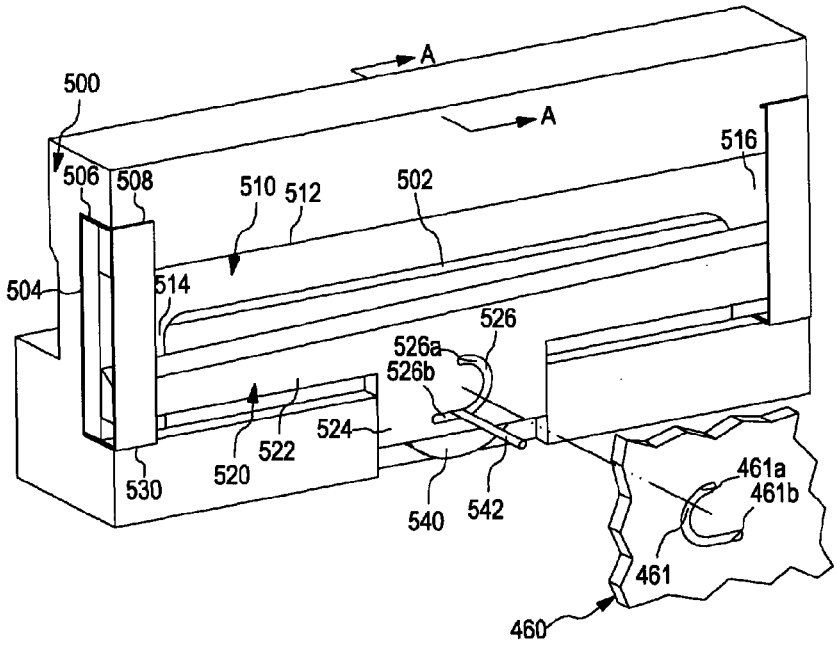

[Fig. 28]
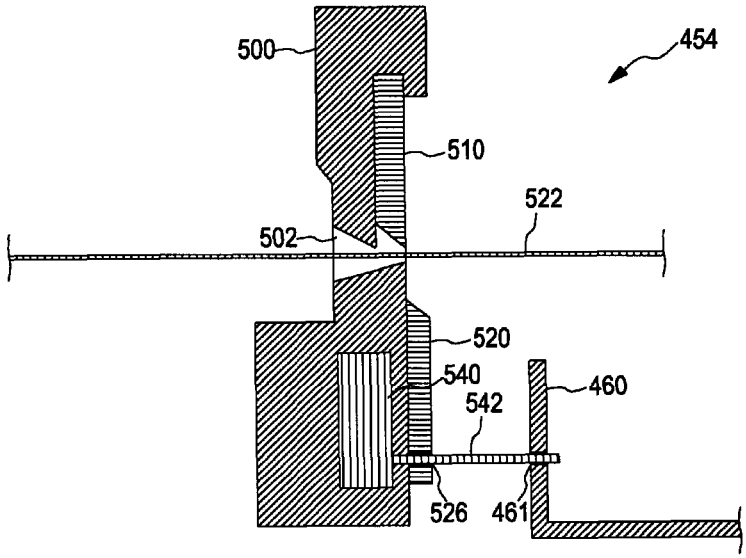
[Fig. 29]
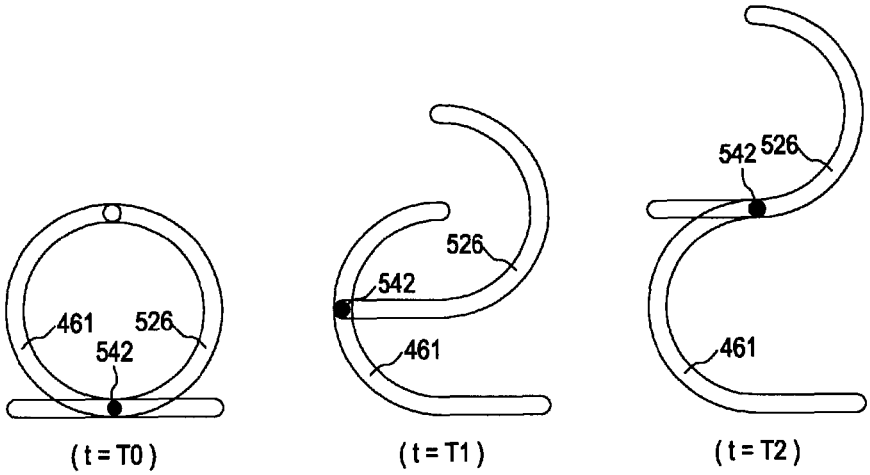
[Fig. 30]
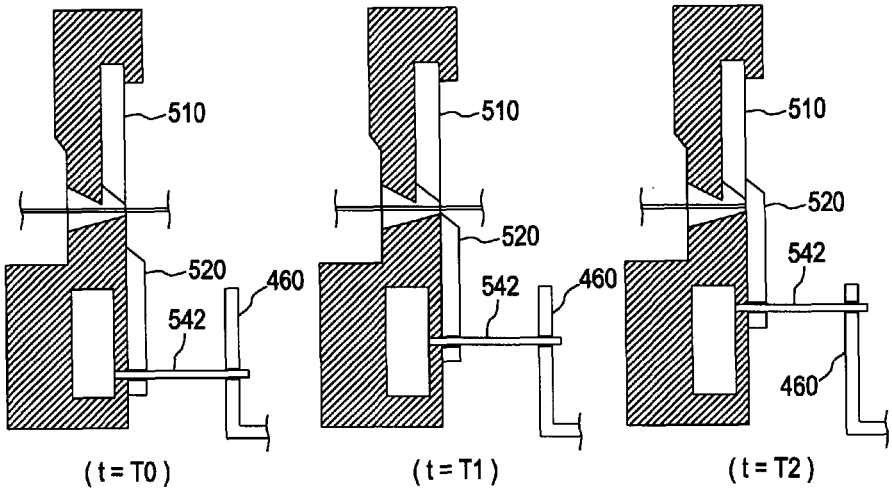

[Fig. 31]
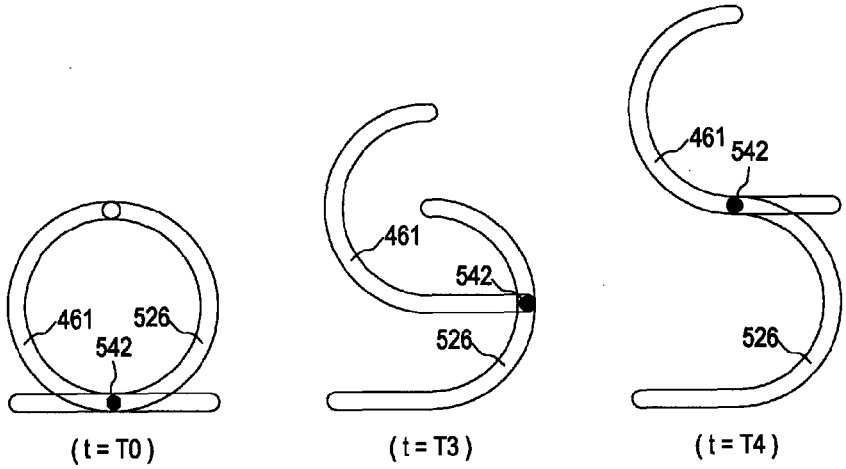
[Fig. 32]
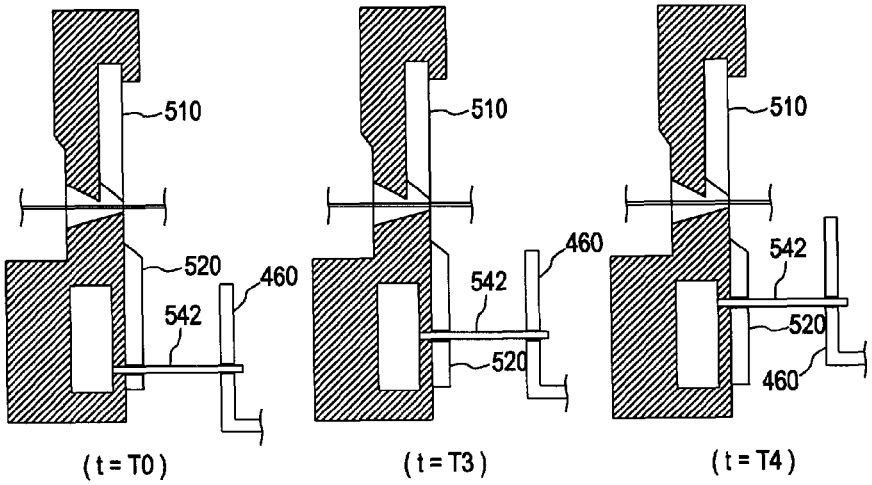
[Fig. 33]
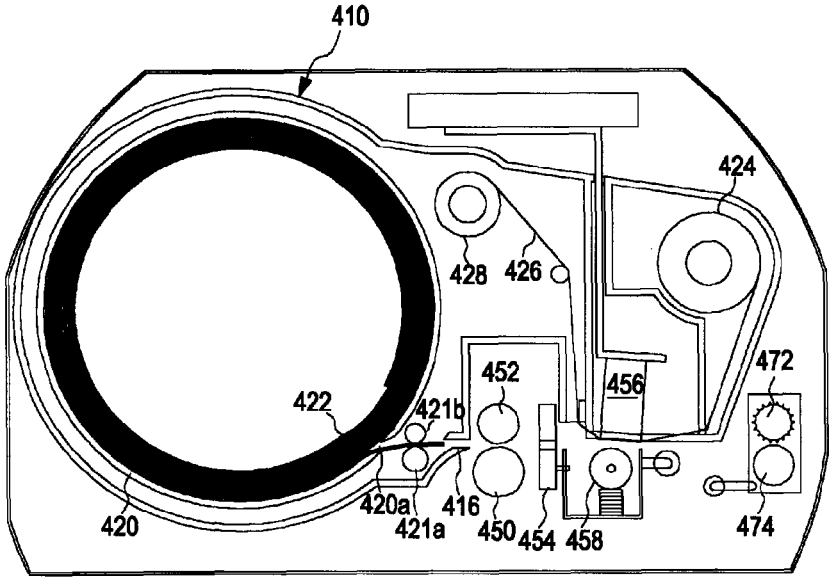

[Fig. 34]
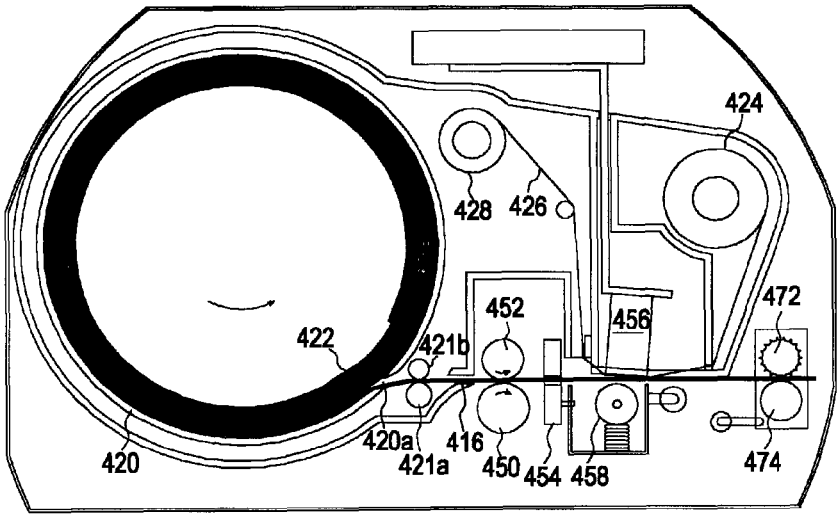
[Fig. 35]
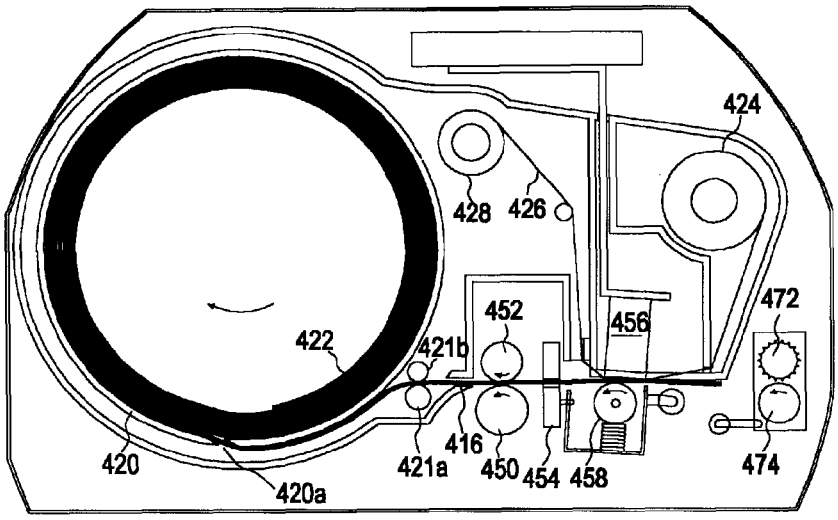
[Fig. 36]
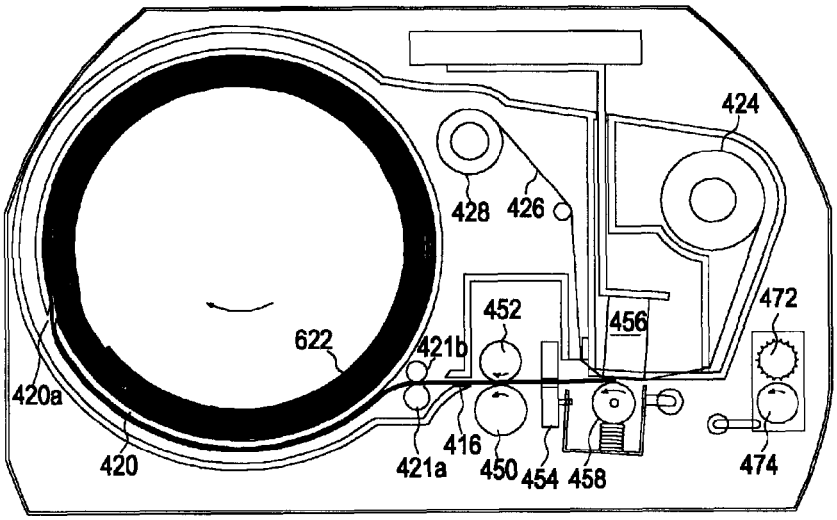

[Fig. 37]
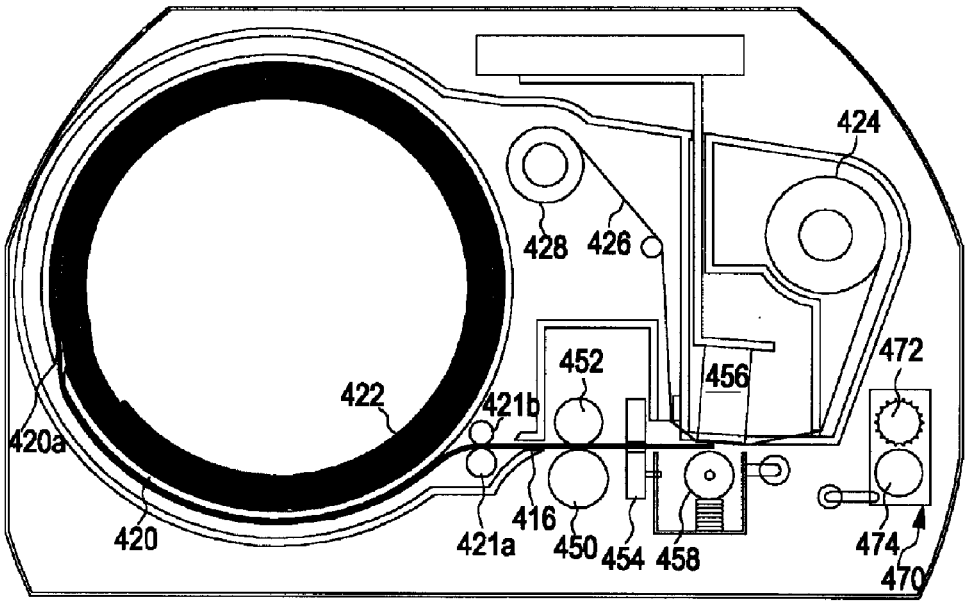
[Fig. 38]
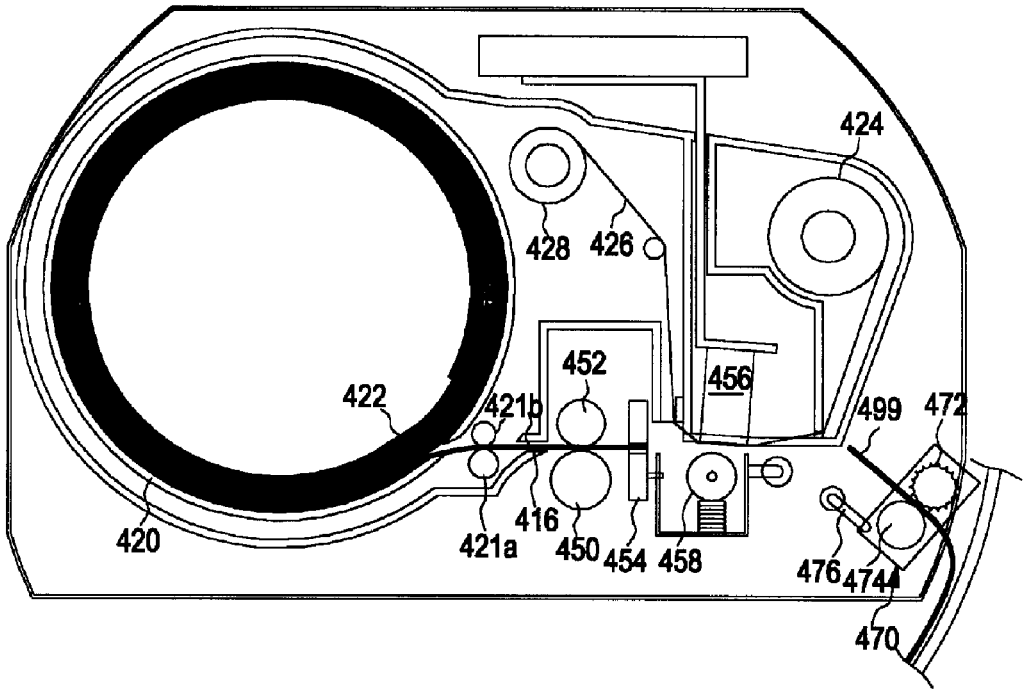

PRINTER CARTRIDGE UNIFYING THERMAL RIBBON AND TRANSFER MEDIUM AND THERMAL TRANSFER PRINTER EMPLOYING THE SAME

This application claims the benefit of Korean Application Nos. 10-2005-0042264, filed May 20, 2005, 10-2005-0045744, filed May 30, 2005, 10-2005-0051227, filed Jun. 15, 2005, 10-2005-0055078, filed Jun. 24, 2005, 10-2005-0077076, filed Aug. 23, 2005 and 10-2005-0111948, filed Nov. 22, 2005, and PCT Application No. PCT/KR2006/001642, filed May 2, 2006 in the Korean Intellectual Property Office, the disclosures of which are incorporated herein by reference.

TECHNICAL FIELD

The present invention relates to a printing apparatus, and more particularly, to a thermal transfer printing apparatus. Also, the present invention is directed to a printer cartridge suitable for use in the printing apparatus.

BACKGROUND ART

As well known in the art, a thermal transfer printer refers to a printing device which applies heat to an ink ribbon so that the ink deposited on the ink ribbon is transferred to a printing medium. Thermal transfer printers are categorized into two types: a sublimation type printer which sublimates the ink on the ink ribbon to the printing medium, and a melting type printer which melts wax-based ink to transfer to the printing medium. The sublimation type printer is widely being used for printing identification cards in a company or other organization, while the melting type printer is being used for printing bar codes, labels, and price tags.

FIG. 1 illustrates an example of conventional thermal transfer printers. A ribbon cartridge 4 is detachably installed inside a housing 2, and a paper cassette 20 detachably installed on one side of the printer. The ribbon cartridge 4 is a frame for accommodating ink ribbon 6, and includes a supply reel 8 for winding and providing unused ink ribbon and a take-up reel 10 for withdrawing used ink ribbon. The ink ribbon 6 is comprised of a base layer made of plastic material, and a donor layer deposited on the base layer and including inks of three colors: yellow (Y), magenta (M), and cyan (C), which is activated by heat application. Along the edge of the ink ribbon are printed codes for allowing the printer to identify the colors of the ink.

Above the front end of the paper cassette 20, is installed a feed roller 30 coupled with the upper end of a lever 32 pivotally mounted within the printer housing to permit the upward and downward movement of the feed roller 30. In front of the feed roller 30 are installed a capstan roller 34 and a pinch roller 35 facing each other. Meanwhile, a thermal printing head (TPH) 38 is fixedly installed in front of the feed roller 30. Underneath the thermal printing head 38, is installed a platen roller 40 coupled with the upper end of a lifting lever 42 pivotally mounted within the printer housing to permit the upward and downward movement of the platen roller 40.

When a printing instruction is applied to the printer, the lever 32 rotates clockwise with respect to its bottom hinge and a feed roller 30 rotates clockwise, so that a sheet of paper contacting the feed roller 30 is fed to be pressed between the capstan roller 34 and the pinch roller 36 and transported in the forward direction. The movement of the paper stops just before the paper passes through an exit 44. Afterwards, the lifting lever 42 moves the platen roller 40 upwards to press the ink ribbon 6 and the print paper 12 against the thermal printing head 38. Then, the capstan roller 34, the supply reel 8, and the take-up reel 10 rotates, and heat elements of the thermal printing head 38 applies heat on the ink ribbon, so that the printing of the yellow (Y) color is initiated. When the printing of yellow (Y) color is completed, the platen roller 40 moves downwards and the paper is transported to the left in the figure, so that the printing of magenta (M) and cyan (C) colors are carried out. After the printing of all colors are completed, the platen roller 40 moves downward, the thermal printing head 38 stops heating, the supply reel 8 and the take-up reel 10 stops rotation, and then the printed paper is discharged outside though the exit 44. Thus, the conventional thermal transfer printer implements a full-color image by repeatedly performing three-color frame-sequential recording on the paper.

The conventional thermal transfer printer, however, has a drawback that it needs extensive installation space because the printer requires a paper cassette protruded out of the printer frame. Since the paper experiencing the back-and-forth motion partially gets out of the printer during the three-color frame-sequential recording, extra space should be provided in front of the printer, which further increases the installation space. Meanwhile, the printer necessitates the feed roller and related components for transporting the paper from the paper cassette, which increases the complexity of the printer. On the other hand, if the ribbon supply reel and the take-up reels are installed far apart, both the reels may have to be driven by a complex motive power transmission, which increases the number of the required components. Besides, the separate installation of the ribbon cartridge and the paper cassette is of nuisance, and lowers the user convenience of the printer.

Considering that Internet and digital cameras is popular and the user of the Internet or the digital camera frequently wishes to personally print a downloaded image or a picture taken by the digital camera, the problems of occupying extensive installation space, complex mechanism, and low convenience are impeding the implementation of a small-sized printer facilitating the personal printing of small pictures.

DISCLOSURE OF INVENTION

Technical Problem

To solve the problems above, one object of the present invention is to provide a printer cartridge for reducing the installation space of a printer by employing a printer paper wound in a roll.

Another object of the present invention is to provide a thermal transfer printer employing the cartridge above for showing simpler structure, occupying less installation space, and enhancing the user convenience.

Technical Solution

In a printer cartridge for solving one of the above objects, a housing has a first opening penetrating the housing and extending laterally. A paper roll case is rotatably installed in the housing and has a second opening penetrating the paper roll case and extending laterally. Inside the paper roll case, a paper roll is stuck on the inner surface of the paper roll case, and paper is wound from the inner surface of the paper roll case to inward direction, while a first end of the paper is exposed through the second opening. The printer cartridge includes means for transporting the first end of the print paper exposed through the second opening to an external position of the first opening. The transporting means is installed between the first opening and the second opening and driven by the printer.

It is preferable that the cartridge includes a supply reel for winding ink ribbon and a take-up reel for winding used ink ribbon, and the supply reel and the take-up reel is installed in a single housing. Also, in a preferred embodiment, the first opening includes a paper opening for providing a path for the paper, a ribbon supply opening for providing a path for the ink ribbon wound in the supply reel to a printing head of the printer, and a ribbon withdrawal opening for providing a path for the used ink ribbon being withdrawn from the printing head to the take-up reel. Further, the cartridge preferably includes a stopper for preventing unwanted rotation of the paper roll case in a state that the cartridge is not installed in the printer while allowing the paper roll case to rotate in a state that the cartridge is installed in the printer.

The thermal transfer printer for solving the another one of the above objects includes a cartridge having print paper wound in a roll, a capstan roller for conveying the print paper by applying frictional force on the print paper, a printing head for printing images on the print paper, and a platen roller for selectively pressing the print paper against the printing head. The housing of the cartridge has a first opening penetrating the housing and extending laterally. A paper roll case is rotatably installed in the housing and has a second opening penetrating the paper roll case and extending laterally. Inside the paper roll case, a paper roll is stuck on the inner surface of the paper roll case, and print paper is wound from the inner surface of the paper roll case to inward direction, while a first end of the print paper is exposed through the second opening. The printer cartridge includes means for transporting the first end of the print paper exposed through the second opening to an external position of the first opening. The transporting means is installed between the first opening and the second opening and driven by the printer.

The printer preferably includes, in a single frame, a supply reel for winding ink ribbon, and a take-up reel for winding used ink ribbon. In such a case, the capstan roller conveys the print paper by applying frictional force on the print paper, and the printing head transfers ink deposited on the ink ribbon to the print paper.

The first opening of the cartridge preferably includes a paper opening for providing a path for the print paper, a ribbon supply opening for providing a path for the ink ribbon wound in the supply reel to the printing head, and a ribbon withdrawal opening for providing a path for the used ink ribbon to the take-up reel. In a preferred embodiment, the capstan roller is installed between the paper opening and the printing head. Also, means for rotating the paper roll case bidirectionally may be provided further. In such a case, the releasing and withdrawal of the print paper wound inside the paper roll case is controlled by the rotating means and the capstan roller.

It is preferable that the printer of the present invention further includes a cutter assembly for cutting printed portion of the print paper. Preferably, the cutter assembly directly cuts the printed portion of the print paper laterally. Here, the cutter assembly may further include a longitudinal cutter for cutting the printed portion of the print paper longitudinally. Alternatively, however, the cutter assembly may form multiple perforations on the edge of the printed portion of the print paper laterally, so that the user may rips the printed portion.

In an embodiment, the cutter assembly is installed before an exit of the printer. Alternatively, however, the cutter assembly may be installed between the paper roll case and the printing head. In such an embodiment, the printer further includes a motor rotatable bidirectionally in a predetermined rotation angle range, and a cam having a cam pin coupled to the motor. The cutter assembly has a first cam hole of a first shape for receiving the cam pin, so that a cutter of the cutter assembly moves up and down by the cam pin according to the rotation of the motor. Also, the platen roller supported by a platen supporting platform has a second cam hole of a second shape for receiving the cam pin, so that the platen roller moves up and down by the cam pin according to the rotation of the motor. It is preferable that the first cam hole includes a first penetration portion of a semicircle shape and a second penetration portion of a linear shape, and the second cam hole includes a third penetration portion of the semicircle shape and a fourth penetration portion of the linear shape. It is preferable that the first penetration portion and the third penetration portion is directed oppositely to each other.

The printer may further include an exit roller installed before an exit of the printer for pushing the printed paper out of the printer, and a exit following roller engaged with the exit roller. It is preferable that multiple protuberances are formed on the surface of the exit roller. Also, it is preferable that the exit roller is equipped with a slip device, and rotates faster than the capstan roller when the printed paper is pushed out of the printer.

ADVANTAGEOUS EFFECTS

According to the present invention, the installation space of the printer is reduced because the printer employs the paper roll and does not include a paper cartridge protruded out of the printer frame. Since the paper experiencing the back-and-forth motion does not get out of the printer during the three-color frame-sequential recording, the installation space is reduced further.

Also, since both the paper roll and ink ribbon rolls are installed in a single cartridge, the print roll and the ink ribbon rolls are replaced simultaneously, which enhances the convenience of the user and the logistics of the manufacturer and the sellers of the printer. Further, the use of the paper roll reduces the feeding time of print paper and reduces the number of operative components for paper feeding and motive power transmission.

It is possible to remove margins in the picture because the printer can proceed with the printing until the front end of the paper exactly reaches the printing position and the cutter can precisely cut the printed portion of the paper. Further, the use of the paper roll facilitates printing of various sizes of images. In particular, the use of the paper roll enables panorama printing of an image longer than a normal sized image or a plurality of images having normal sizes.

When the cutter is disposed between the paper roll and the thermal printing head, it is possible to precisely cut the printed paper to reduce or remove the margin on the printed picture. In such a case, paper dust generated during the paper cutting adheres on the ink ribbon being wound by the take-up reel, and the problems of pixel omission or the deterioration of picture quality resulting from the paper dust can be minimized.

Because the print paper is wound in the paper roll case being stretched in the case, the radius or the roll is maximized and thus the paper curl is minimized.

BRIEF DESCRIPTION OF THE DRAWINGS

The above objectives and advantages of the present invention will become more apparent by describing in detailed preferred embodiments thereof with reference to the attached drawings in which:

FIG. 1 illustrates an example of conventional thermal transfer printers;

FIG. 2 illustrates an embodiment of a thermal transfer printer of the present invention;

FIG. 3 is a cross-sectional view of the thermal transfer printer of FIG. 2;

FIG. 4 is a pictorial view of cartridge shown in FIGS. 2 and 3 seen from a laterally lower position;

FIG. 5 is a perspective view of an embodiment of a paper roll case shown in FIG. 3;

FIG. 6 illustrates the course of outstretching and being rolled up of the paper roll during the assembling of the paper roll case of FIG. 3;

FIG. 7 is a exploded view of another embodiment of the paper roll case shown in FIG. 3;

FIG. 8 is a cross-sectional view of the paper roll case of FIG. 7;

FIG. 9 is a block diagram showing the electrical configuration of the printer shown in FIGS. 2 and 3;

FIGS. 10 through 15 illustrate the operation of the printer of FIGS. 2 and 3;

FIG. 16 illustrates a cutting example of a cutter assembly;

FIG. 17 is a cross-sectional view of another embodiment of the thermal transfer printer of the present invention;

FIGS. 18 and 19 illustrate the operation of the printer of FIG. 17;

FIG. 20 illustrates the concept of the panorama printing of the present invention;

FIG. 21 is a flowchart showing the process of the panorama printing of the present invention;

FIGS. 22 and 23 are flowcharts showing another embodiment of the panorama printing of the present invention;

FIG. 24 illustrates an example of partitioning of a print image while performing the printing method of FIGS. 22 and 23;

FIG. 25 is a perspective view of another embodiment of the printer of the present invention;

FIG. 26 is a cross-sectional view of the printer of FIG. 25;

FIG. 27 illustrates a cutter assembly shown in FIG. 26;

FIG. 28 is a cross-sectional view of the cutter assembly of FIG. 27 taken along the line A-A;

FIGS. 29 and 30 illustrate the operation of a cam pin of the cutter assembly of FIG. 27 while cutting the paper;

FIGS. 31 and 32 illustrate the operation of the cam pin of the cutter assembly of FIG. 27 while moving the platen roller up and down; and FIGS. 33 through 38 illustrate the operation of the printer of FIGS. 25 and 26.

BEST MODE FOR CARRYING OUT THE INVENTION

FIG. 2 illustrates an embodiment of a thermal transfer printer of the present invention. Hereinbelow, the external surface of the printer shown in the right of FIG. 2 is referred to as front face, and the opposite surface of the printer is referred to as rear face. The printer of the present embodiment generally, having a rectangular paral-lelepiped shape, has a LCD display 50 for displaying status information of the printer, and plural keys for user input. A door 54 is installed on the left side of the printer. A groove for receiving a cartridge 70 is formed inside the door 54. Also, a plurality of components including a thermal printing head 104 are installed inside the printer as described below.

Magnets 56*a* and 56*b* are attached on the upper side of the inner surface of the door 54 and metal plates 58*a* and 58*b* corresponding to the magnets 56*a* and 56*b* are attached on the lateral side of the main body, so that the door 54 maintains closed condition by the magnets 56*a* and 56*b* and the metal plates 58*a* and 58*b*. The door can by opened by pulling knobs 60*a* and 60*b* formed near the center of lateral sides of the door 54. Inhalation holes 62 are formed near the thermal printing head 104, and a cooling fan not shown in the figure is installed on the opposite side so as to radiate heat generated by the thermal printing head 104. Meanwhile, an exit 120 for pushing out a printed paper is formed on the lower position of the front surface of the printer.

FIG. 3 is a cross-sectional view of the thermal transfer printer of FIG. 2, and FIG. 4 is a pictorial view of cartridge 70 seen from a laterally lower position.

The cartridge 70 is a frame for receiving print paper and ink ribbon, and includes a rear receiving portion 72 having a rounded external surface and a front receiving portion 82 extending forward from the rear receiving portion 72. On one side of the cartridge 70, is provided a handle 71 for facilitating withdrawal of the cartridge during the change or maintenance of the cartridge. Near the connecting position of the rear receiving portion 72 and the front receiving portion 82, a groove 80 depressed upwards from bottom surface and extending laterally is formed in the cartridge 70 to receive a capstan roller 100 and/or a pinch roller 102 of the printer. The rear receiving portion 72 has an opening 74 formed toward the groove 80 enabling the print paper 78 to penetrate the cassette case. It is preferable that the opening 74 has a form of a slit having short height and much longer width.

A paper roll case 76 having a wound print paper roll is rotatably installed inside the rear receiving portion 72 so as to facilitate the release and withdrawal of the print paper. The paper roll case 76 has an opening 77 for allowing the print paper 78 to penetrate the case. In front of the paper roll case 76, are provided a sub-pinch roller 79*a* and a counter pinch roller 79*b* facing each other for guiding the print paper released from the paper roll case 76 to the capstan roller 100 and the pinch roller 102.

Inside the front receiving portion 82, are rotatably installed a supply reel for winding unused ink ribbon 99 and releasing the ink ribbon 99 during the printing operation and a take-up reel 94 for withdrawing used ink ribbon. In front of the supply reel 92 and the take-up reel 94, a head receiving groove 84 depressed upwards from bottom surface and extending laterally is formed in the cartridge 70 to receive the thermal printing head 104. The head receiving groove 84 includes partitioning walls 86 and 88, and a ceiling plate 90 connecting the top ends of the partitioning walls 86 and 88. Near the bottom ends of the partitioning walls 86 and 88, are formed a first and a second openings 87 and 89, respectively, for providing a path for the ink ribbon 99. Thus, the ink ribbon wound at the supply reel 92 travels through the first and the second openings 87 and 89 through the first and second idling rollers 96 and 98 to be wound by the take-up reel 94.

In an embodiment of the present invention, the supply the supply reel 92 and the take-up reel 94 are engaged with an idling gear 93, so that the rotary force applied to the take-up reel 94 is applied also to the supply reel 92. Considering the change of the rotation speeds of the supply reel 92 and the take-up reel 94 as the migration of the ink ribbon from the supply reel 92 to the take-up reel 94, it is preferable that the idling gear 93 is equipped with a slip device including, e.g., a felt and a spring.

In the groove 80 formed under the cartridge 70, is installed the capstan roller 100 which rotates bidirectionally driven by a power source not shown in the figure to transport the print paper at a constant speed. The pinch roller 102 is supported by a spring not shown in the figure and engaged with the capstan roller 100. Meanwhile, inside the head receiving groove 84 of the cartridge 70, is laterally disposed the thermal printing head 104, of which one end is fixed at the internal frame of the printer. The thermal printing head 104 includes multiple heating elements which are disposed in a row and heated individually in response to a signal from a printer controller. The thermal printing head 104 is engaged with a platen roller 106 which is supported by a lifting lever 108 and moves up and down to selectively press the print paper 78 and the ink ribbon 99 against the thermal printing head 104 for facilitating the thermal transfer of ink to the print paper 78.

Between the platen roller 106 and the exit 120 of the printer, is installed an exit roller 110 engaged with an exit following roller 112. It is preferable that multiple protuberances are formed on the surface of the exit roller 110 for smoothing out the print paper and prevent the print paper from slippery. In order to prevent that wrinkles are introduced on the printed paper while the printed paper is being pulled out, the exit roller 110 preferably rotates slightly faster than the capstan roller 100 (e.g., at a rotating speed 1.1 times faster than the capstan roller 100). In such a case, it is preferable that the exit roller 110 is equipped with a slip device for allowing the exit roller 110 to slip when excessive pulling force is applied to the print paper. Since the slip device can easily be implemented using felts and springs by those skilled in the art, the detailed description of the slip device will be omitted in this specification.

Meanwhile, before the exit 120, is installed a cutter assembly 114 for cutting the printed portion of the print paper. On the other hand, under the cartridge, a first guide member 116 for supporting print paper is installed between the capstan roller 100 and the platen roller 106, and a second guide member 118 is installed between the platen roller 106 and the exit roller 110.

FIG. 5 shows an embodiment of a paper roll case 76 shown in FIG. 3. According to the present embodiment, the paper roll case 76 includes a first and a second covers 130*a* and 130*b* both having semicircular cross section. The first and the second covers 130*a* and 130*b* are coupled through hinges formed at one edges thereof. In an embodiment, the rotational axis is divided, along the center axis of the paper roll case 76, into two parts 132*a* and 132*b*, each of which is formed on the first and the second covers 130*a* and 130*b*, respectively. Alternatively, however, the rotational axis can be formed only on the first cover 130*a* while the cross section of the first cover 130*a* is made to be larger than that of the second cover 130*b*. In order to assemble the paper roll case, hooks 134 are formed in one of the first and the second covers 130*a* and 130*b*, while eyes 136 are formed in the other one of the covers 130*a* and 130*b*. Meanwhile, one or both of the first and the second covers 130*a* and 130*b* includes an opening for enabling the passage of the print paper pass. In particular, in the embodiment of FIG. 5, the recesses 138*a* and 138*b* formed at the edges of the first and the second covers 130*a* and 130*b* plays the role of the opening in a combination state, which opening corresponds to the opening 77 shown in FIG. 3. Also, it is preferable to provide a stopper, between the cartridge housing and the paper roll case 76, for preventing unwanted rotation of the paper roll case 76 in a state that the cartridge is not installed in the printer. Since those skilled in the art can easily implement such a stopper, the detailed description of the stopper will be omitted.

The paper roll case 76 is assembled as follows. First, the paper roll is inserted into the first cover 130*a*, while the front end of the paper is pulled out of the recesses 138*a* and 138*b*. Afterwards, pressing for maintaining the roll is released. Then, the paper stretches away inside the first cover 130*a*, until a new roll having a larger radius and stuck fast on the inner surface of the first cover 130*a* is formed as shown in FIG. 6. In this state, the second cover 130*b* is put on the first cover 130*a* and the hooks 134 are engaged with the eyes 136.

FIGS. 7 and 8 shows another embodiment of the paper roll case 76. According to the present embodiment, the paper roll case is divided, perpendicularly to the extending direction of the case, into a first and a second covers 140*a* and 140*b*, each having a rotational axis 142 at the end. In this embodiment, the paper roll is inserted into the first cover 140*a*, and the front end of the paper is pulled out of the opening 142. When the pressing for maintaining the roll is released, the paper stretches away inside the first cover 140*a*, until a new roll having a larger radius and stuck fast on the inner surface of the first cover 140*a* is formed. Afterwards, the second cover 140*b* is fit to the first cover 140*a* and the hooks 146 are engaged with the eyes 148.

FIG. 9 shows the electrical configuration of the printer shown in FIGS. 2 and 3. The printer can be connected to a data terminal such as a personal computer and a digital camera to receive print data. A printer controller 150 receives the print data from the external data terminal through an interface 152 to stores in a memory 154, and controls the general operation of the printer. The memory 154 stores firmware for operating the controller 150, and stores and buffers the print data. In this printer, the controller 150 applies heating control signal to the thermal printing head 104 according to the print data to control the heating of the thermal printing head 104. Also, the controller 150 controls, through the motor driving unit 156, the rotation of the paper roll case 76, the supply reel 92, the take-up reel 94, the capstan roller 100, the platen roller 106, the lifting lever 108, and the exit roller 110. The paper roll case 76, the supply reel 92, the take-up reel 94, the capstan roller 100, the platen roller 106, the lifting lever 108, and the exit roller 110 is driven by a motor installed in the printer frame through a power coupler such as gears and belts. Meanwhile, the controller 150 drives a cutter assembly driver 158 for controlling the cutter assembly 114 to cut the printed paper properly.

The printer operates as follows.

Initially, the printer stays in a state shown in FIG. 10, in which the print paper is wound inside the paper roll case 76 and the front end is interposed between the sub-pinch 79*a* and the counter pinch 79*b*. Such a position of the front end of the print paper is determined during the assembly of the cartridge 70.

If power is applied to the printer in this state, the sub-pinch 79*a* and the counter pinch 79*b* rotates, the front end of the print paper 78 is drawn out of the paper roll case 76 through the opening 77 to be interposed between the capstan roller 100 and the pinch roller 102. Owing to the clockwise rotation of the capstan roller 100 and counterclockwise rotation of the pinch roller 102, the front end of the print paper reaches the upper position of the platen roller 106 with the assistance of the first guide member 116. As the paper roll case 76, the capstan roller 100, and the pinch roller 102 continue to rotate, the front end of the print paper reaches the cutter assembly 114 through the exit roller 110 and the exit following roller 112 being supported by the second guide member 118. When such transport of the print paper is completed, the printer waits for printing instruction in a state shown in FIG. 11. In a preferred embodiment, the distance between the printing position of the thermal printing head 104 and the cutter assembly 114 is the same as or approximate to the length of one print paper, and the printing can be initiated without further movement of the print paper after the application of the printing instruction.

When the printing instruction is applied to the printer, the lifting lever 108 pivots counterclockwise with respect to the hinge at its bottom end to elevate the platen roller 106, and thus, the platen roller 106 presses the print paper 78 and the ink ribbon 99 against the thermal printing head 104 at an appropriate pressure. Subsequently, the print paper 78 moves back in state being interposed between the capstan roller 100 rotating counterclockwise and the pinch roller 102 rotating clockwise by the capstan roller 100. At this time, the paper roll case 76 rotatable freely with respect to the rotation axis rotates clockwise being pushed back by the thick and stiff print paper, and the print paper is transported backwards through the space between the paper roll case 76 and the cartridge housing. Meanwhile, the take-up reel 94 rotates clockwise to pull the ink ribbon 99 and the platen roller 106 rotates counterclockwise, so that the print paper 78 and the ink ribbon 99 moves backwards at the same speed while experiencing frictional force between them. In such a condition, the thermal printing head 104 applies heat to the ink ribbon 99 so that the ink of yellow (Y) color deposited on the ink ribbon 99 is transferred to and settled on the print paper.

When the printing of the yellow (Y) color is completed as the front end of the print paper reaches the printing position, the point between the thermal printing head 104 and the platen roller 106, as shown in FIG. 13, a paper sensor not shown in the figure detects the progress of the printing to send an electrical signal to the controller 150. Under the control of the controller 150, the capstan roller 100, and the pinch roller 102, and the paper roll case 76 stop rotation as shown in FIG. 14, and the lifting lever 108 pivots clockwise with respect to the hinge at its bottom end to lower the platen roller 106. At this time, the take-up reel 94 may rotate further until a ribbon sensor not shown in the figure detects that the starting end of the magenta (M) color arrives the printing position.

Afterwards, owing to the rotation of the sub-pinch 79*a*, the counter pinch 79*b*, and the capstan roller 100, the print paper moves forwards until the front end of the print paper reaches the cutter assembly 114 to return to the state of FIG. 11. Subsequently, the platen roller 106 is elevated by the lifting lever 108 to press the print paper 78 and the ink ribbon 99 against the thermal printing head 104 at an appropriate pressure. Also, the capstan roller 100, the paper roll case 76, and the take-up reel 94 rotates and the thermal printing head 104 applies heat to the ink ribbon 99 to perform the printing of magenta (M) color.

When the printing of the magenta (M) color is completed, the rotation of the sub-pinch 79*a*, the counter pinch 79*b*, the capstan roller 100, and the pinch roller 102 stops and the platen roller 106 is lowered by the lifting lever 108. Subsequently, owing to the rotation of the sub-pinch 79*a*, the counter pinch 79*b*, and the capstan roller 100, the print paper moves forwards until the front end of the print paper reaches the cutter assembly 114 to return to the state of FIG. 11. Afterwards, the platen roller 106 is elevated by the lifting lever 108 to press the print paper 78 and the ink ribbon 99 against the thermal printing head 104 at an appropriate pressure. Also, the capstan roller 100, the paper roll case 76, and the take-up reel 94 rotates and the thermal printing head 104 applies heat to the ink ribbon 99 to perform the printing of cyan (C) color.

After all the colors are completely printed, the capstan roller 100, the pinch roller 102, and the paper roll case 76 stops rotation, and the platen roller 106 is lowered by the lifting lever 108 as shown in FIG. 14. Afterwards, the capstan roller 100 rotating clockwise drives the front end of the print paper to push out of the exit 120 through the exit roller 110 and the exit following roller 112. At this time, the exit roller 110 facilitates the push-out of the printed paper while suppressing the slippery of the paper, and the multiple protuberances formed on the surface of the exit roller 110 stretches the curl of the print paper. When the tail of the printed portion of the printed paper reaches the cutter assembly 114, the cutter assembly 114 cuts the print paper 78 to discharge the printed paper though the exit 120.

As described above, according to the printer of the present embodiment, both the paper roll and ink ribbon rolls are installed in a single cartridge, and the print paper wound in the paper roll case 76 moves back and forth to print a full color image by frame-sequential recording. As the printing process advances, the ink ribbon wound in the supply reel is transported to and wound by the take-up reel 94, and the printed paper is pushed out through the exit.

The printer according to the preferred embodiment of the present invention is suitable for printing an A6-sized picture in a condition of being connected to a personal computer or a digital camera. However, the present invention is not limited to the size of the paper but can be adapted to various applications. Also, the printer can be optimized for printing an A4-sized picture while allowing the printing of the A6-sized picture as shown in FIG. 16. In such a printer, the cutter assembly 115 preferably includes a longitudinal cutter for cutting the printed portion of the print paper longitudinally in addition to the lateral cutter. The longitudinal cutter may be driven by an actuation mechanism such as a solenoid valve to move up and down for selective use. The printer controller 150 determines the size of the picture received from the data terminal such as the personal computer to be printed, and drives the actuation mechanism to activate the longitudinal cutter for longitudinal cutting. Since those skilled in the art can easily implement the longitudinal cutter and the actuation mechanism based on this specification, detailed description thereof will be omitted.

Meanwhile, it was described above that the distance between the printing position of the thermal printing head 104 and the cutter assembly 114 is the same as or approximate to the length of one printed paper preferably, so as to initiate the printing just after the application of the printing instruction without any further movement of the paper and to prevent the paper from partially getting out of the printer during the printing process. Alternatively, however, the distance between the printing position of the thermal printing head 104 and the cutter assembly 114 may be shorter than the length of one printed paper, so that the paper partially gets out through the exit 120 and returns before the printing of each color.

In another embodiment of the present, invention, the printer may include a space for receiving front end of the paper which may get out of the printer when the printing of each color is initiated. FIG. 17 shows such an embodiment of the printer. In FIG. 17, between the thermal printing head 104 and the exit roller 110 is provided a shutter 200, which switches between two positions to change the paper path. When the printer paper is to be transported forwards, the shutter 200 rotates counterclockwise in the figure under the control of the controller 150, so that the rear end of the shutter 200 is turned down and the front end of the print paper moves upwards along the shutter 200 as shown in FIG. 18. At this time, the guide member 202 functions as a paper path preventing the print paper from being folded or rolled up. On the other hand, when the print paper is to be pushed out through the exit 120, the shutter 200 rotates clockwise in the figure, so that the rear end of the shutter 200 is turned up and the front end of the print paper can be transported to the exit 120 through the cutter assembly 114 as shown in FIG. 19. In the case that the printed image is much longer than the size of the printer, a separate reel for temporarily winding the front end of the paper may be provided further at the top of the guide member 202.

As mentioned above, the printer according to a preferred embodiment, is suitable for printing A6-sized pictures under the connection to a personal computer or a digital camera. However, the printer of the present invention may be used to print a picture having the same width as the A6-size but much larger longitudinal length than the A6-size. The printing of such a long picture is referred to as panorama printing in this specification. FIG. 20 exemplifies sizes of printed paper gone through the normal printing and the panorama printing. For the panorama printing, it is preferable to provide a separate panorama-printing cartridge of which length of each ink layer is 1.1 to 10 times larger than a common cartridge. The maximum length of the paper printed by the panorama printing is determined by the length of each ink layer on the ink ribbon.

The panorama printing enables the user to print an image having the width of 105 millimeter and the length of 163 to 1485 millimeters using a printer optimized for printing A6-sized image, e.g., having the width of 105 millimeter and the length of 148.5 millimeter. Thus, the user can print a plurality of consecutive images of golf swinging motion or an image edited by an image editor such as the PHOTOSHOP (Trademark) in a print paper. The panorama printing is not limited to the A6-size adapted printer, can be applied to the printer adapted for other kinds of size, e.g., A4-size, as well.

FIG. 21 shows the process of the panorama printing of the present invention. In a preferred embodiment, the user can manually choose either the panorama printing mode or the normal printing mode using the key input. Alternatively, however, the controller 150 automatically determines the operation mode based on the size of the image to be printed out. Upon receiving the printing instruction, the controller 150 determines whether the current operation to be performed is the panorama printing mode (step 250). If the operation mode is not the panorama printing mode, the controller 150 performs the normal operation mode (step 252). If, however, the operation mode is determined to be the panorama printing mode in the step 250, the controller 150 determines whether the panorama-printing cartridge is installed in the printer by detecting a tap (not shown) on the external surface of the cartridge 70 using a sensor (step 254). If the panorama-printing cartridge is installed in the printer, the controller 150 displays a message PANORAMA PRINTING on the display 50 and performs the panorama printing mode (step 256). On the other hand, if the panorama-printing cartridge is not installed in the printer, the controller 150 displays an error message such as INK CARTRIDGE MISMATCH on the display 50 in step 258 and terminates the printing process.

On the other hand, according to an alternative embodiment, the printer can carry out the panorama printing mode using a common cartridge rather than the panorama-printing cartridge. FIGS. 22 and 23 shows the panorama printing process in such a printer. In the printing method of FIGS. 22 and 23, the printer receives print data for an image wider than typical print paper from the personal computer to print the image on the typical print paper. Preferably, the controller 150 counts the vertical scanning lines from the received image data and determines the operation mode. Alternatively, however, the controller 150 may receive the operation mode data when receiving the image data from the personal computer to perform the panorama printing based on the operation mode data.

In the preferred embodiment, when printing the image having the length L as shown in FIG. 24, the printer calculates the vertical scanning lines from the print image data buffered in the memory 204, and calculates the multiples (n) of the length (L) of the received image compared with the length (Lf) of the normal print paper to repeat, n or n+1 times, the printing of partitioned images without cutting the paper. For example, if the length (L) of the received image is 5.4 times longer than the length (Lf) of the normal print paper, the printer performs printing of five partitioned images on 5Lf-long print paper without cutting the printed paper and then prints the remaining image of length (L0=0.4 Lf) on another paper portion. Consequently, the printer performs six steps of printing process on the 5.4Lf-long paper portion without cutting the printed paper. Afterwards, the printer cuts the printed paper having the length of 5.4Lf. During such a printing process, the paper roll case releases the print paper of length L, and then the printer sequentially prints the first through the n-th images and finally prints the remaining image of length L0.

Referring to FIGS. 22 and 23, the controller 150 calculates the length of the print image (L) in step 300, and determines whether to perform the panorama printing mode in step 302. If it is determined in the step 302 that the panorama printing mode is not needed, the controller 150 performs the normal printing mode (step 304). Meanwhile, if it is determined in the step 302 that the panorama printing mode is to be performed, the printer performs the panorama printing operation in the steps 306 through 326.

First, the controller 150 calculates the number of normal print images (n) and the length of remaining image (L0) from the length of the image (L) (step 306). Afterwards, the controller 150 controls the paper roll case 76 and the capstan roller 100 to rotate counterclockwise and clockwise, respectively, similarly to the operation shown in FIG. 11, so that the front end of the print paper is pushed out through the exit 120 and the printing position faces the paper position spaced apart by the image length (L) from the front end of the print paper 78 (step 308). Subsequently, the controller 150 detects the start of the yellow (Y) color in the ink ribbon using the ribbon sensor in step 310, and moves the platen roller 106 upwards so that the platen roller 106 presses the print paper 78 and the ink ribbon 99 against the thermal printing head 104 in step 312. Then, the controller 150 controls the thermal printing head 104 to apply heat on the ink ribbon for printing the yellow (Y) color in step 314. Upon completion of the yellow color until the end of the first picture, the capstan roller 100 stops rotation and the platen roller 106 releases the pressing of the print paper and the ink ribbon in step 316.

Next, the paper roll case 76 and the capstan roller 100 are rotated in the reverse direction, counterclockwise, to transport the print paper until the start of the first picture reaches the printing position (step 320). After detecting the start of the magenta (M) color using the ribbon sensor in step 310, the printing of the magenta (M) color of the first picture is carried out through the steps 312 to 316. Also the printing of the cyan (C) color of the first picture is carried out through the steps 310 to 316. Further, the black (B) color and/or the overcoating (OV) layer, if available, is printed similarly. Upon completion of printing an ink layer of each color, it is determined whether all the colors are completely printed in the step 318. In the case that there is any color having not printed yet, that color layer is printed over the picture area in the steps 320 and 310 through 316 to implement the frame-sequential recording.

If it is determined in the step 318 that all the colors are completely printed for the first picture, it is determined whether there remains any further picture to be printed in step 322. If there is a picture to be printed, the steps 310 through 320 are carried out again to print the second picture without moving of the print paper because the end of the first picture coincides with the start of the second picture. That is, after detecting the start of the yellow (Y) color in the ink ribbon in the step 310, the controller 150 controls the paper roll case 76, the capstan roller 100, the platen roller 106, and the thermal printing head 104 to perform the printing of yellow (Y) color of the second picture in the steps 312 through 316. Until all the colors are completely printed for the second picture, the print paper is transported so that the start of the picture faces the printing position in the step 320, and color lay is printed for the second picture in the steps 310 through 316.

Similarly, if it is determined in the step 318 that all the colors are completely printed for the second picture, it is determined whether there remains any further picture to be printed in step 322. If there is a picture to be printed, the steps 310 through 320 are carried out again to print the third picture without moving of the print paper because the end of the second picture coincides with the start of the third picture. Thus, whenever it is determined in the step 318 that all the colors are completely printed for the second picture, it is determined whether there remains any further picture to be printed in step 322. If there remains a picture to be printed, the steps 310 through 320 are carried out to print the next picture without moving of the print paper because the end of the current picture coincides with the start of the next picture.

Upon completion of printing all the pictures having the length of the normal print paper (Lf), the controller 150 checks the existence of a remaining picture having the length (L0) shorter than the length of the normal print paper (Lf), proceeds to print the remaining picture in the (n+1)-th printing stage. That is, if it is determined in the step 318 that all the colors are completely printed for the n-th picture, the controller 150 determines whether there is the remaining picture in the step 322. If there is the picture, the steps 310 through 320 are carried out again to print the remaining picture without moving of the print paper because the end of the n-th picture coincides with the start of the remaining picture. When the remaining picture is printed, however, printing of each ink layer is carried out only for the length of the remaining picture (L0) rather than the full length of the normal printing paper (Lf).

If it is determined that all the colors are completely printed for the remaining picture, the controller 150 controls the capstan roller 100 in the reverse direction to transport the print paper until the start of the first picture reaches the cutter assembly 114 in step 324. Finally, the cutter assembly 114 cuts the print paper, and the exit roller 110 pushes the printed paper out of the exit 120.

Meanwhile, the panorama printing method shown in FIGS. 22 through 24 is not limited to the printer of FIG. 3, that is, the printer employing the cartridge of FIG. 4, but is applicable to any thermal transfer printer employing the roll-type print paper.

Because of the characteristics of using print paper wound in a roll to eliminate the paper cassette, the printer of the present invention can be designed in a variety of styles. For example, the printer of the present invention can be designed into a cylindrical shape as shown in FIG. 25, which may reduce the installation space further.

The printer of FIG. 25 includes a cylindrical housing 402, a printer frame 406 fixedly installed in the housing 402, and a cartridge 410 detachably installed in the frame 406. Preferably, the top face of the frame 402 is detachably manufactured so as to function as a lid for allowing the user to change the cartridge 410. Also, a portion of the lid 404 can be opened and closed by use of hinges 405, so that the user can pick a printed paper out of the housing 402. Meanwhile, the printer preferably includes a LCD display not shown in figure, and a keypad for user input. Further, it is preferable to form a projection on the surface of the printer for preventing the printer from rolling over the table when the printer is collapsed on the table.

FIG. 26 is a cross-sectional view of the printer of FIG. 25. Hereinbelow, the right side of the FIG. 26 is referred to as front side, and the left side of the FIG. 26 is referred to as rear side for the convenience of explanation.

The cartridge 410 is a frame for receiving print paper and ink ribbon, and includes a rear receiving portion 412 having a rounded external surface and a front receiving portion 414 extending forwards from the rear receiving portion 412. Near the connecting position of the rear receiving portion 412 and the front receiving portion 414, a groove 418 depressed upwards from bottom surface and extending laterally is formed in the cartridge 410 to receive a capstan roller 450 and/or a pinch roller 452, and a cutter assembly 454. The rear receiving portion 412 has an opening 416 formed toward the groove 418 enabling the print paper 422 to penetrate the cassette case.

A paper roll case 420 having a wound print paper roll is rotatably installed inside the rear receiving portion 412. Inside the front receiving portion 414, is rotatably installed a supply reel 424 for winding unused ink ribbon 426 and releasing the ink ribbon 426 during the printing operation. Over the groove 418, is rotatably installed a take-up reel 428 for withdrawing used ink ribbon. Between the supply reel 424 and the take-up reel 248, is installed a rib plate 430 for structurally supporting the cartridge 410, and an opening 432 for providing a path for the ink ribbon 426 is formed near the bottom end of the rib plate 430. It is preferable to provide a crown-shaped wrinkle eliminating piece over the opening 432 on the rear surface of the rib plate 430.

In front of the rib plate 430, a head receiving groove 438 is formed in bottom surface of the cartridge 410 to receive the thermal printing head 456. Above the head receiving groove 438, is installed a heat radiating plate 440 for radiating heat generated by the thermal printing head 456 to the heat radiating pins 442. In front of the head receiving groove 430, is installed a partitioning wall 444 for thermally isolating the supply reel 424 from the heat radiating plate 440. Near the bottom end of the partitioning wall 444, is formed an opening 446 for providing a path for the ink ribbon 426. Thus, the ink ribbon wound at the supply reel 424 travels through the opening 426, the opening 432, an idling roller 436 to be wound by the take-up reel 428.

In the groove 418 formed under the cartridge 410, is installed the capstan roller 450 which rotates bidirectionally driven by a power source not shown in the figure to transport the print paper at a constant speed. The pinch roller 452 is supported by a spring not shown in the figure and engaged with the capstan roller 450. In front of the capstan roller 450 and the pinch roller 452, is installed a cutter assembly 454114 for cutting the printed portion of the print paper. According to the present embodiment, the distance between the paper roll case and the cutter is minimized, and the cutter can precisely cut the printed paper to eliminate undesired margin in the printed paper. In addition, the present embodiments can minimize the amount of paper dust adhering on the ink ribbon.

Meanwhile, inside the head receiving groove 438 of the cartridge 410, is laterally disposed the thermal printing head 456, of which one end is fixed at the internal frame of the printer. The thermal printing head 456 includes multiple heating elements which are disposed in a row and heated individually in response to a signal from a printer controller. The thermal printing head 456 is engaged with a platen roller 458 which is supported by a platen supporting platform 460. The platen supporting platform 460 can move up and down, by the operation of a cam pin of the cutter assembly 454 to selectively press the print paper 422 and the ink ribbon 426 against the thermal printing head 456 for facilitating the thermal transfer of ink to the print paper 422.

Between the platen roller 458 and the exit 120 of the printer, is installed an exit roller carrier 470 which includes an exit roller 472 and an exit following roller 474 and can be swung by a lever 476. The exit roller carrier 470 maintains the state shown in FIG. 26 in a standby state, but is swung clockwise in the figure by the lever 476 for enabling the front end of the paper to move along the inner surface of the cylindrical housing 402 in a printing state. It is preferable that multiple protuberances are formed on the surface of the exit roller 472 for smoothing out the print paper and prevent the print paper from slippery. In order to prevent that wrinkles are introduced on the printed paper while the printed paper is being pulled out, the exit roller 472 preferably rotates slightly faster than the capstan roller 450 (e.g., at a rotating speed 1.1 times faster than the capstan roller). In such a case, it is preferable that the exit roller 472 is equipped with a slip device for allowing the exit roller 472 to slip when excessive pulling force is applied to the print paper. Since the slip device can easily be implemented using felts and springs by those skilled in the art, the detailed description of the slip device will be omitted in this specification.

The paper roll case 240 has a cylindrical shape in an assembled state, has rotational axes on each side for enabling bidirectional rotation in a state installed in the printer. Since the paper roll case of the present embodiment is similar to those shown in FIG. 3 or FIG. 5, the detailed description thereof will be omitted.

FIGS. 27 and 28 shows the cutter assembly 454 shown in FIG. 26 in detail.

A cutter base 500 mechanically supporting the cutter assembly 454 has an opening 502 elongated laterally, and the vertical width of the opening 502 widens to the back for facilitating the entry of the end of the print paper. A recess 504 for receiving a upper cutter 510 and a lower cutter 520 is formed on the front surface of the cutter base 500. A groove 506 for receiving the top end of the upper cutter 510 is formed on the upper internal surface of the recess 504, and slits 508 connecting the recess 504 to the front surface to the cutter base 500 are formed at both ends of the recess 504 for inserting clips 530.

The upper cutter 510 includes a horizontal portion 512 elongated laterally, and vertical portions 514 and 516 elongated downwards from the end of the horizontal portion 512. The lower edge of the horizontal portion 512 partially overlaps with the opening 502 of the cutter base 500, and the lower edge of the horizontal portion 512 is tapered at a certain angle, so that the edge operates as a blade.

The lower cutter 520 includes a horizontal portion 522 elongated laterally, and a vertical portion 524 elongated downwards from the center of the horizontal portion 522. The upper edge of the horizontal portion 522 is tapered at a certain angle, so that the edge operates as a blade. It is preferable that the height of the vertical horizontal portion 522 widens from one end to the other end, so that the cutting proceeds across the print paper from one end to the other end. A cam hole 526 is formed on the vertical portion 524 of the lower cutter 520. In a preferred embodiment, the cam hole 526 includes a first penetration portion 526*a* having a semicircle shape and a second penetration portion 526*b* elongated in a linear pattern to the left (in FIG. 27) from the lower end of the first penetration portion 526*a*.

A motor is installed inside the lower portion of the cutter base 500, and the motor is connected to a cam plate 540 installed on the rear surface of the lower cutter 520. A cam pin 542 is formed or attached on the front face of the cam plate 540 correspondingly to the cam hole 526. In a state of being inserted in the cam hole 526 of the lower cutter 520, the cam pin 542 can elevate and descend the lower cutter 520 driven by the motor.

Meanwhile, in the preferred embodiment, the cam pin 542 can elevate and descend the platen supporting platform 460 and the platen 458 in addition to the lower cutter 520 of the cutter assembly 454. For this purpose, a cam hole 461 similar to that in the lower cutter 520 is formed on the rear surface of the platen supporting platform 460. The cam hole 461 includes a third penetration portion 461*a* having a semicircle shape and a fourth penetration portion 461*b* elongated in a linear pattern to the right (in FIG. 27) from the lower end of the third penetration portion 461*a*.

The cutter assembly 454 is assembled as follows. After inserting the top end of the upper cutter 510 into the groove 506 of the cutter base 500, the rear surface of the upper cutter 510 is put in close contact to the front surface of the recess 504 of the cutter base 500. Afterwards, the cam pin 542 is inserted through the cam hole 526 of the lower cutter 520, and the rear surface of the lower cutter 520 is put in close contact to the front surface of the cutter base 500 and the upper cutter 510. Next, clips 530 for covering both ends of the upper cutter 510 and the lower cutter 520 is fitted into the slits 508 to secure the strength of the cutter assembly 454.

In the above embodiment, the cutter assembly 454 operates as follows.

First, the operation of cutting paper is described with reference to FIGS. 29 and 30. In a normal state (t=T0), the cam pin 542 of the cam plate 540 stays in the position at which that the first penetration portion 526*a* having the semicircle shape intersects the second penetration portion 526*b* having the linear shape. At this time, the cam pin 542 stays in the similar position for the cam hole 461 of the platen supporting platform 460. If the cam plate 540 rotates clockwise in the figure, the cam pin 542 slides in the second penetration portion 526*b* and exerts force to the upper edge of the second penetration portion 526*b* of the lower cutter 520 to elevate the lower cutter 520 (t=T1, T2). Accordingly, the blades of the upper cutter 510 and the lower cutter 520 cross each other to cut the print paper 422. After the cutting is completed, the cam plate 540 and the cam pin 542 returns to the original position, and the lower cutter 520 returns to the original position, also. During the cutting operation, the cam pin 542 of the cam plate 540 slides in the third penetration portion 461*a* while influencing little on the movement of the platen supporting platform 460.

Next, the movement of the platen supporting platform 460 is described with reference to FIGS. 31 and 32. In a normal state (t=T0), the cam pin 542 of the cam plate 540 stays in the position at which that the first penetration portion 526*a* intersects the second penetration portion 526*b*. At this time, the cam pin 542 stays in the similar position for the cam hole 461 of the platen supporting platform 460. If the cam plate 540 rotates counterclockwise in the figure, the cam pin 542 slides in the fourth penetration portion 461*b* and exerts force to the upper edge of the fourth penetration portion 461*b* of platen supporting platform 460 to elevate the platen supporting platform 460 (t=T1, T2). Accordingly, the platen 458 presses the print paper 422 and the ink ribbon 426 against the thermal printing head 456, so that the ink deposited on the ink ribbon 426 is transferred to the print paper 422. When the transferring of the ink is completed, the cam plate 540 and the cam pin 542 returns to the original position, and the platen supporting platform 460 returns to the original position, also. During this operation, the cam pin 542 of the cam plate 540 slides in the first penetration portion 526*a* while influencing little on the movement of the lower cutter 520.

Thus, this embodiment of the present invention can carry out both the cutting operation and the movement of the platen supporting platform 460 using a single motor and cam plate.

The printer described above operates as follows.

Initially, the printer stays in a state shown in FIG. 33, in which the print paper 422 is wound inside the paper roll case 420 and the front end is interposed between the sub-pinch 421*a* and the counter pinch 421*b*. Such a position of the front end of the print paper is determined during the assembly of the cartridge 410.

If power is applied to the printer in this state, the sub-pinch 421*a* and the counter pinch 421*b* rotates, the front end of the print paper 422 is drawn out of the paper roll case 420 through the opening 420*a* to be interposed between the capstan roller 450 and the pinch roller 452. Owing to the clockwise rotation of the capstan roller 450 and counterclockwise rotation of the pinch roller 452, the front end of the print paper reaches the upper position of the platen roller 458 through the cutter assembly 454. As the capstan roller 450 and the pinch roller 452 continue to rotate, the front end of the print paper passes the exit roller 472 and the exit following roller 474 to reach the state shown in FIG. 34.

Afterwards, the cam pin 542 of the cam plate 540 in the cutter assembly 454 lifts up the platen supporting platform 460 as shown in FIG. 35. Accordingly, the platen supporting platform 460 rotates with respect to the hinge 462 to elevate the platen 458, which presses the print paper 422 and the ink ribbon 426 against the thermal printing head 456 at an appropriate pressure. Subsequently, the print paper 422 moves back being interposed between the capstan roller 450 rotating counterclockwise and the pinch roller 452 rotating clockwise by the capstan roller 450. At this time, the paper roll case 420 rotatable freely with respect to the rotation axis rotates clockwise being pushed back by the thick and stiff print paper, and the print paper is transported backwards through the space between the paper roll case 420 and the cartridge housing. Meanwhile, the take-up reel 428 rotates counterclockwise to pull the ink ribbon 426 and the platen roller 456 rotates counterclockwise, so that the print paper 422 and the ink ribbon 426 moves backwards at the same speed while experiencing frictional force between them. In such a condition, the thermal printing head 456 applies heat to the ink ribbon 426 so that the ink of yellow (Y) color deposited on the ink ribbon 426 is transferred to and settled on the print paper.

When the printing of the yellow (Y) color is completed as the front end of the print paper reaches the printing position, the contact point of the thermal printing head 456 and the platen roller 458, as shown in FIG. 36, the printer controller counting the number of revolutions stops the rotation of the capstan roller 450, and the pinch roller 452, and the paper roll case 420 as shown in FIG. 37. Then, the cam plate 540 in the cutter assembly 454 rotates to return the cam pin 542 and the platen supporting platform 460 to their original position, and thus the platen supporting platform 460 rotates with respect to the hinge 462 to descend the platen 458. At this time, the take-up reel 428 may rotate further until a ribbon sensor not shown in the figure detects that the starting end of the magenta (M) color arrives the printing position.

Afterwards, owing to the rotation of the sub-pinch 421*a*, the counter pinch 421*b*, and the capstan roller 450, the print paper moves forwards until the front end of the print paper passes the exit roller 472 and the exit following roller 474 to return to the state of FIG. 34. Subsequently, the platen roller 458 is elevated by the cam plate 540 in the cutter assembly 454 to press the print paper 422 and the ink ribbon 426 against the thermal printing head 456 at an appropriate pressure. Also, the capstan roller 450, the paper roll case 420, and the take-up reel 94 rotates and the thermal printing head 456 applies heat to the ink ribbon 426 to perform the printing of magenta (M) color.

When the printing of the magenta (M) color is completed, the sub-pinch 420*a*, the counter pinch 420*b*, the capstan roller 450, and the pinch roller 452 stops rotation as shown in FIG. 37. Also, the cam plate 540 in the cutter assembly 454 rotates to return the cam pin 542 and the platen supporting platform 460 to their original position, and thus the platen supporting platform 460 rotates with respect to the hinge 462 to descend the platen 458. At this time, the take-up reel 428 may rotate further until a ribbon sensor not shown in the figure detects that the starting end of the magenta (M) color arrives the printing position. Afterwards, owing to the rotation of the sub-pinch 421*a*, the counter pinch 421*b*, and the capstan roller 450, the print paper moves forwards until the front end of the print paper passes the exit roller 472 and the exit following roller 474 to return to the state of FIG. 34. Subsequently, the platen roller 458 is elevated by the cam plate 540 in the cutter assembly 454 to press the print paper 422 and the ink ribbon 426 against the thermal printing head 456 at an appropriate pressure. Also, the capstan roller 450, the paper roll case 420, and the take-up reel 94 rotates and the thermal printing head 456 applies heat to the ink ribbon 426 to perform the printing of magenta color (C). Also, in the case that a black color (B) or a overcoating (OV) layer for preventing the deterioration of the print layer is provided in the ink ribbon, such color or layer may be printed further similarly.

After all the colors are completely printed, the capstan roller 450, the pinch roller 452, and the paper roll case 420 stops rotation, and the platen roller 106 is lowered by the cam plate 540 in the cutter assembly 454 as shown in FIG. 37. Afterwards, the capstan roller 450 rotating clockwise drives the front end of the print paper in the forward direction. When the tail of the printed portion of the printed paper reaches the cutter assembly 454, the motor in the cutter assembly 454 rotates the cam plate 540 and the cam pin 542, so that the cam pin 542 lifts the lower cutter 520. Thus, the blades of the upper cutter 510 and the lower cutter 520 cross each other to cut the print paper 422. After the cutting is completed, the cam plate 540 and the cam pin 542 returns to the original position, and the lower cutter 520 returns to the original position, also. Next, the exit roller 472 and the exit following roller 474 rotates to transport the printed paper 499 while the lever 476 pivots to displace the exit roller carrier 470 to the state shown in FIG. 38. Accordingly, the printed paper 499 is pushed out through the exit 478. When the printed paper 499 is pushed out completely, the exit roller carrier 470 returns to its original position.

As described above, according to the printer of the present embodiment, both the paper roll and ink ribbon rolls are installed in a single cartridge, and the print paper wound in the paper roll case 420 moves back and forth to print a full color image by frame-sequential recording. As the printing process advances, the ink ribbon wound in the supply reel is transported to and wound by the take-up reel 94, and the printed paper is pushed out through a slit provided in the housing. Alternatively, however, the printed paper may be pushed out to the space between the housing and the printer frame, so that the user can pick out the printed paper after opening the cover of the cylindrical housing.

While the housing has a top cover in the above description, the housing may be configured to split vertically into two pieces each having semispherical cross section. On the other hand, the printer shown in FIG. 25 can be made of translucent material such as acryl resin, so that the internal mechanisms can be seen outside of the printer.

As described above, according to the printer shown in FIGS. 25 through 38, the distance between paper roll and the cutter is minimized, and the cutter can precisely cut the printed paper to eliminate undesired margin in the printed paper. Also, the present embodiments can reduce the amount of paper dust remaining near the print paper because some portion of the dust adheres on the ink ribbon being wound by the take-up reel. Thus, the problems of pixel omission or the deterioration of picture quality resulting from the paper dust can be minimized. Meanwhile, the number of mechanical component is reduced because the printer carries out both the cutting operation and the vertical movement of the platen a single motor and cam plate.

Although the present invention has been described in detail above, it should be understood that foregoing description is illustrative and nor restrictive. For example, though the transport of the ink ribbon was described in terms of the take-up reel only, both the supply reel and the take-up reel are driven by a single motor. In such a case, a slipping device can selectively block the transmission of the rotary power.

Though it was described that the thermal printing head is fixed while the platen roller is allowed to move vertically, it is possible that the platen roller is fixed while the thermal printing head is allowed to move vertically.

Instead of automatically cutting the printed portion of the print paper, the cutter assembly may form multiple perforations on the edge of the printed portion of the print paper laterally, so that the user may rips the printed portion.

Though it was described that the printing is performed while the print paper and the ink ribbon is transported to the rear direction, it is possible to perform the printing while transporting the print paper and the ink to the forward direction under the condition that the supply reel and the take-up reel is interchanged. In such an embodiment, the positions of the capstan roller and the pinch roller preferably are changed to the space between the thermal printing head and the exit.

On the other hand, the structure of the paper roll case, the position and configuration of the cutter assembly, the shape of the printer, and the other features exemplified in the embodiments above can be applied to the other embodiments.

Thus, those of ordinary skill in the art will appreciate that many obvious modifications can be made to the invention without departing from its sprit or essential characteristics. We claim all modifications and variation coming within sprit and scope of the following claims.

INDUSTRIAL APPLICABILITY

As described above, in the printer of the present invention both the paper roll and ink ribbon rolls are installed in a single cartridge, which enhances the convenience of the user. The use of the paper roll reduces the number of operative components and installation space of the printer. In the case that the cutting operation and the movement of the platen is performed by a single motor, the number of components are reduced further.

The paper curl introduced is minimized since the print paper is wound in the paper roll case being stretched in the case to have the maximum radius. In the case that the cutter is disposed between the paper roll and the thermal printing head, it is possible to precisely cut the printed paper to reduce or remove the margin on the printed picture. In such a case, paper dust generated during the paper cutting adheres on the ink ribbon being wound by the take-up reel, and the problems of pixel omission or the deterioration of picture quality resulting from the paper dust can be minimized.

The printer of the present invention is suitable for, but not limited to, printing photographs being connected to the personal computer or the digital camera.

The invention claimed is:

1. A cartridge for use in a printer, comprising:

a housing having a first opening penetrating said housing and extending laterally;

a paper roll case rotatably installed in said housing and having a second opening penetrating said paper roll case and extending laterally; and a paper roll stuck on inner surface of said paper roll case and including a paper wound from the inner surface of said paper roll case to inward direction, wherein a first end of the paper is exposed through the second opening.

2. The cartridge as claimed in claim 1, further comprising:

a supply reel, installed in said housing, for winding ink ribbon; and a take-up reel, installed in said housing, for winding used ink ribbon.

3. The cartridge as claimed in claim 2, wherein the first opening includes:

a paper opening for providing a path for the paper;

a ribbon supply opening for providing a path for the ink ribbon wound in said supply reel to a printing head of the printer; and a ribbon withdrawal opening for providing a path for the used ink ribbon being withdrawn from the printing head to said take-up reel.

4. The cartridge as claimed in claim 1, further comprising:

a stopper for preventing unwanted rotation of said paper roll case in a state that the cartridge is not installed in the printer while allowing said paper roll case to rotate in a state that the cartridge is installed in the printer.

5. A printer comprising:

a cartridge having print paper wound in a roll;

a capstan roller for conveying the print paper by applying frictional force on the print paper;

a printing head for printing images on the print paper; and a platen roller for selectively pressing the print paper against said printing head, wherein said cartridge comprises:

a housing having a first opening penetrating said housing and extending laterally, a paper roll case rotatably installed in said housing and having a second opening penetrating said paper roll case and extending laterally; and a paper roll stuck on inner surface of said paper roll case and including the print paper wound from the inner surface of said paper roll case to inward direction, wherein a first end of the paper is exposed through the second opening.

6. The printer as claimed in claim 5, wherein said cartridge further comprises: means, installed between the first opening and the second opening and driven by the printer, for transporting the first end of the print paper exposed through the second opening to an external position of the first opening, wherein the printer further comprises:

means for generating driving force to drive said transporting means of said cartridge.

7. The printer as claimed in claim 5, wherein said cartridge further comprises:

a supply reel for winding ink ribbon; and a take-up reel for winding used ink ribbon, wherein the printer further comprises:

a capstan roller for conveying the print paper by applying frictional force on the print paper, wherein said printing head transfers ink deposited on the ink ribbon to the print paper.

8. The printer as claimed in claim 5, wherein the first opening includes:

a paper opening for providing a path for the print paper;

a ribbon supply opening for providing a path for the ink ribbon wound in said supply reel to said printing head; and a ribbon withdrawal opening for providing a path for the used ink ribbon to said take-up reel.

9. The printer as claimed in claim 8, further comprising:

means for rotating said paper roll case bidirectionally, wherein the releasing and withdrawal of the print paper wound inside said paper roll case is controlled by said rotating means and said capstan roller.

10. The printer as claimed in claim 8, wherein said capstan roller is installed between the paper opening and said printing head.

11. The printer as claimed in claim 8, further comprising:

a first guide member for supporting the print paper between said capstan roller and said printing head.

12. The printer as claimed in claim 8, further comprising:

a second guide member for supporting the print paper between said printing head and an exit of the printer.

13. The printer as claimed in claim 7, further comprising:

a cutter assembly, installed before an exit of the printer, for cutting printed portion of the print paper.

14. The printer as claimed in claim 13, wherein said cutter assembly directly cuts the printed portion of the print paper laterally.

15. The printer as claimed in claim 14, wherein said cutter assembly comprises:

a longitudinal cutter for cutting the printed portion of the print paper longitudinally.

16. The printer as claimed in claim 13, wherein said cutter assembly forms multiple perforations on the edge of the printed portion of the print paper laterally.

17. The printer as claimed in claim 7, further comprising:

a cutter assembly, installed between said paper roll case and said printing head, for cutting printed portion of the print paper.

18. The printer as claimed in claim 17, further comprising:

a motor rotatable bidirectionally in a predetermined rotation angle range; and a cam having a cam pin coupled to said motor, wherein said cutter assembly has a first cam hole of a first shape for receiving said cam pin, so that a cutter of said cutter assembly moves up and down by said cam pin according to the rotation of said motor, wherein said platen roller is supported by a platen supporting platform having a second cam hole of a second shape for receiving said cam pin, so that said platen roller moves up and down by said cam pin according to the rotation of said motor.

19. The printer as claimed in claim 18, wherein the first cam hole includes a first penetration portion of a semicircle shape and a second penetration portion of a linear shape, wherein the second cam hole includes a third penetration portion of the semicircle shape and a fourth penetration portion of the linear shape, wherein the first penetration portion and the third penetration portion is directed oppositely to each other.

20. The printer as claimed in claim 7, further comprising:

an exit roller installed before an exit of the printer for pushing the printed paper out of the printer; and a exit following roller engaged with said exit roller, wherein multiple protuberances are formed on the surface of said exit roller.

21. The printer as claimed in claim 20, wherein said exit roller is equipped with a slip device, and rotates faster than said capstan roller when the printed paper is pushed out of the printer.

22. The printer as claimed in claim 7, wherein said cartridge comprises: an idling gear for transmit rotational power of either of said supply reel and said take-up reel to another one of said supply reel and said take-up reel.

23. The printer as claimed in claim 22, wherein at least one of said supply reel, said take-up reel, and said idling gear has a slip device.

24. The printer as claimed in claim 7, wherein said printing head is fixed vertically, and said platen roller moves up and down by a lifting lever of which one end is supported by the frame of the printer.

25. The printer as claimed in claim 7, wherein said platen roller is fixed vertically, and said printing head moves up and down by a lifting lever of which one end is supported by the frame of the printer.

26. The printer as claimed in claim 7, further comprising:

a shutter, installed before the exit of the printer, for selectively guiding the front end of the print paper to the exit.

27. The printer as claimed in claim 26, further comprising:

an idling roller installed before or above said shutter.

28. The printer as claimed in claim 7, further comprising:

a housing of a cylindrical shape.

29. The printer as claimed in claim 28, wherein an opening for discharging the printed paper is formed on a side of said cylindrical housing.

30. The printer as claimed in claim 28, wherein said cylindrical housing is made of translucent material.

* * * * *